US011191339B2

(12) United States Patent
Giron et al.

(10) Patent No.: US 11,191,339 B2
(45) Date of Patent: Dec. 7, 2021

(54) ASSEMBLY AND PROCESS FOR MOULDING KERATIN FIBRES

(71) Applicant: L'OREAL, Paris (FR)

(72) Inventors: Franck Giron, Chevilly-Larue (FR); Henri Samain, Chevilly-Larue (FR); Jean-Baptiste Blanc, Chevilly-Larue (FR); Anne Bouchara, Chevilly-Larue (FR)

(73) Assignee: L'OREAL, Paris (FR)

( * ) Notice: Subject to any disclaimer, the term of this patent is extended or adjusted under 35 U.S.C. 154(b) by 369 days.

(21) Appl. No.: 15/772,688

(22) PCT Filed: Nov. 21, 2016

(86) PCT No.: PCT/EP2016/078307
§ 371 (c)(1),
(2) Date: May 1, 2018

(87) PCT Pub. No.: WO2017/089299
PCT Pub. Date: Jun. 1, 2017

(65) Prior Publication Data

US 2019/0159575 A1 May 30, 2019

(30) Foreign Application Priority Data

Nov. 27, 2015 (FR) ..... 1561505

(51) Int. Cl.
*A45D 40/26* (2006.01)
*A41G 5/02* (2006.01)

(52) U.S. Cl.
CPC ..... *A45D 40/26* (2013.01); *A41G 5/02* (2013.01); *A45D 2200/1072* (2013.01); *A45D 2200/157* (2013.01); *A45D 2200/207* (2013.01)

(58) Field of Classification Search
CPC ..... A41G 5/02; A41G 5/0086; A45D 2/48; A45D 40/30
(Continued)

(56) References Cited

U.S. PATENT DOCUMENTS 2,421,432 A 10/1944 Phillips
3,559,657 A 2/1971 Bau
(Continued)

FOREIGN PATENT DOCUMENTS

EP 0951897 A2 10/1999
KR 20130082357 A 7/2013
(Continued)

OTHER PUBLICATIONS

"Wax Comparison Chart." DPS Wax, Inc. , DPS Wax, Inc. , Aug. 2015, www.dpswax.com/resources/wax-chart. (Year: 2015).*
(Continued)

*Primary Examiner* — Jacqueline T Johanas
*Assistant Examiner* — Sarah Woodhouse
(74) *Attorney, Agent, or Firm* — Shumaker, Loop & Kendrick, LLP

(57) ABSTRACT

The present invention relates to an assembly including at least one cosmetic composition for the cosmetic treatment of eyelashes or eyebrows, and a device including a mould having two mould parts to be closed on the eyelashes, with at least one of these parts having a concave groove, which is concave towards the proximal edge of the mould, especially curvilinear, allowing the formation of a strip of composition connecting at least part of the eyelashes along the eyelid or the eyebrow arch.

29 Claims, 10 Drawing Sheets

(58) Field of Classification Search
USPC ..... 132/216, 217, 218; 424/401, 70.7
See application file for complete search history.

(56) References Cited

U.S. PATENT DOCUMENTS 3,670,742 A * 6/1972 Weaner ..... A41G 5/02 132/216
5,156,911 A 10/1992 Stewart
5,307,826 A * 5/1994 Iosilevich ..... A45D 40/262 132/218
6,105,585 A * 8/2000 Thomas ..... A45D 34/042 132/216
6,325,071 B1 * 12/2001 Butcher ..... A45D 40/264 132/218
6,789,551 B2 * 9/2004 Iosilevich ..... A45D 2/48 132/216
2005/0217691 A1 * 10/2005 Petit ..... A46B 9/021 132/320
2007/0227550 A1 10/2007 Merzei
2008/0017215 A1 * 1/2008 Thiebaut ..... A46B 5/0012 132/218
2010/0215605 A1 * 8/2010 Arditty ..... A61K 8/062 424/70.11
2013/0152960 A1 6/2013 Pays et al.

FOREIGN PATENT DOCUMENTS

WO 0119333 A1 3/2001
WO 2008088098 A1 7/2008

OTHER PUBLICATIONS

Chinese Office Action for CN App. No. 2016800695671 dated Mar. 25, 2019 along with English translation (16 pages).
International Search Report for PCT/EP2016/078307 dated Feb. 17, 2017 (3 pages).
International Search Report for PCT/EP2016/078307 dated Feb. 17, 2017.

* cited by examiner

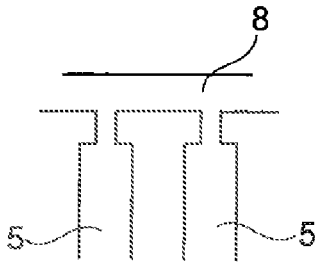
Fig. 38
Fig. 39A
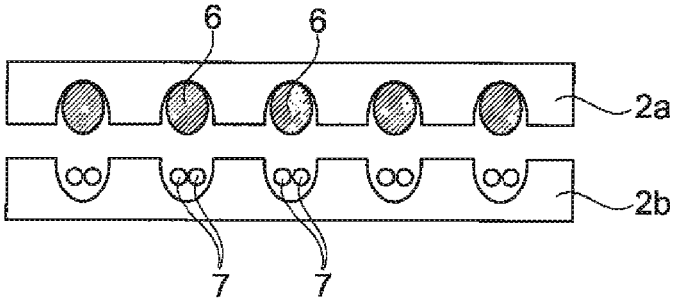
Fig. 39B
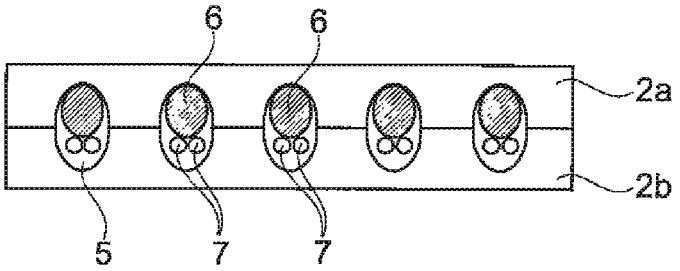
Fig. 39C
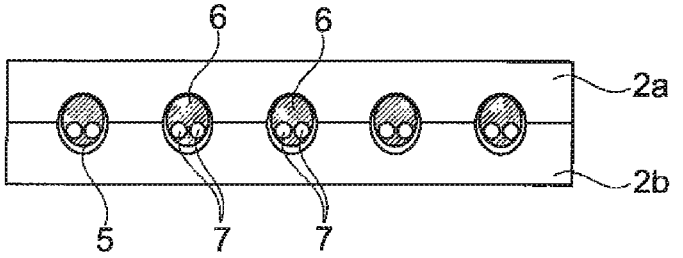
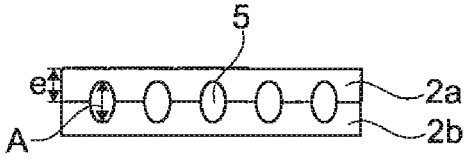
Fig. 40 A
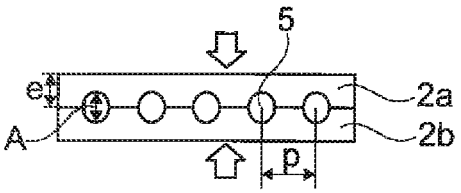
Fig. 40 B

ASSEMBLY AND PROCESS FOR MOULDING KERATIN FIBRES

TECHNICAL FIELD AND BACKGROUND

The present invention relates to the cosmetic treatment of human keratin fibres, especially eyelashes or eyebrows.

It is sought to cosmetically treat keratin fibres in order to give them greater visibility and/or an original appearance.

Known solutions exist, such as the application of mascara and the use of additional fibres.

The first of these two solutions is effective for increasing eyelash visibility, but it is limited in terms of gain in visibility.

Attempts have been made to exceed this limit, in particular by increasing the amount of material deposited. If the material deposited is increased by means of a suitable brush, or by increasing the number of brushstrokes, a limit is quickly reached, due to the fact that, at each new deposit, almost as much material is removed as is deposited. Unattractive overloads and agglomerates are frequently created.

This solution is also limited by the number of possible aesthetic effects. For example, it is very difficult to obtain very smooth and therefore very glossy coatings.

The second solution consists in sticking additional fibres, in particular false eyelashes, onto the eyelashes.

A first technique consists in sticking false eyelash fringes onto the eyelid: they are difficult to put in place and the result is not very natural. Furthermore, persistence is low, being limited to approximately one day. Such false eyelash fringes, and also the processes for producing them, are described in patents U.S. Pat No. 2,421,432 and U.S. Pat No. 3,559,657.

Another technique consists in sticking false eyelashes onto the eyelashes one by one: the effect is not very visible, is longer lasting but lengthy to perform, expensive and can only be carried out by an individual working in the field.

SUMMARY

A means for cosmetically treating eyelashes in order to obtain effects of high volume and/or great length, without the risk of eyelashes sticking together, is therefore sought. A means for creating new effects on keratin fibres, such as smooth and glossy coating effects, all with a process that is easy to use, is also sought.

Hereinbelow, the term "eyelash" denotes both the fringe of hairs of the eyelid and those of the eyebrows.

Unless otherwise mentioned, the magnitudes according to the invention are given at room temperature and pressure, i.e. respectively at 25° C. and at 1 atmosphere.

Effects of Multiple Branches

Many people lament the fact that they have impoverished eyelash fringes, with fewer eyelashes than they would like.

Applying mascara is a potential solution for making the eyelashes more visible. However, this solution is not always satisfactory since, by increasing the thickness of the eyelashes, grouping of eyelashes in bundles may also be created, and the number of apparent eyelashes is further reduced. The eyelashes may also be made up with a mascara while taking care to avoid grouping. However, in this case, the makeup on the eyelashes is very light and does not completely solve the problem.

Applying eyelashes extensions is not satisfactory either, since it demands considerable work, often at a prohibitive cost.

According to a first of its aspects, the invention is directed toward finding a practical solution for obtaining an eyelash-charging effect and an aspect in which the eyelashes appear enhanced.

According to this first aspect, the subject of the invention is an assembly comprising:

- at least one cosmetic composition for the cosmetic treatment of human keratin fibres, especially eyelashes or eyebrows, and
- a device comprising a mould comprising at least one cavity into which at least one of said fibres may be at least partially introduced, so that the composition is moulded onto at least part of the fibre present in the cavity, said cavity having at least one branching so that the moulding of the composition onto the fibre leads to the formation of at least two branches directed outwards.

Instead of depositing, as in the prior art, a composition on the keratin fibres while forcing it to spread thereon, for example using a brush, or of sticking on additional fibres, especially false eyelashes, according to this aspect of the invention a composition is moulded around the keratin fibres. This composition is moulded in the fluid state, and then sets, which allows removal from the mould and the formation of the abovementioned branches.

This makes it possible to control the shape of the deposit of composition on the treated fibres and to obtain, whatever the dexterity of the individual, a reproducible result.

The formation of branches directed outwards by moulding on the eyelashes makes it possible to give the imprint of greater eyelash density.

The invention thus makes it possible readily to generate novel shapes and effects that are sparingly accessible in the prior art, especially an enhanced eyelash effect, to exceed if so desired the length of the keratin fibres or the thickness of the usual deposits, or even to produce inaccessible colour or gloss effects, and readily to incorporate additional fibres, such as false eyelashes, if so desired. The surface finish of the mould may be chosen so as to give the deposit a smooth external surface and a glossy appearance if so desired.

The cavity or cavities may be formed by bringing together two jaws, especially via a translational movement of one of the two jaws with respect to the other, each jaw bearing a mould part. Each mould part may comprise imprints intended for forming the cavities or, as a variant, only one of the two mould parts comprises such imprints. Each mould part may be made of an elastically deformable material, such as a silicone. The composition may be borne initially by one of the mould parts only or by both of them.

The branches may form points. Thus, an eyelash may bear several moulded points.

Where appropriate, the branches connect several eyelashes, which may tend towards unifying their curvature and making them manageable.

The mould may comprise a plurality of cavities, into each of which at least one of said fibres may be at least partially introduced, so that the composition is moulded onto at least part of each fibre present in the corresponding cavity, the cavities each having at least one branching so that the moulding of the composition onto the fibres leads to the formation of at least two branches per fibre onto which the composition is moulded.

The cavities for receiving the eyelashes are preferably generally oriented perpendicular to the adjacent proximal edge of the mould.

All the cavities of the mould may have branchings. As a variant, only some of the cavities have branchings.

The branching may be located at more than half the length of the corresponding cavity from its proximal end. This makes it possible to conserve more mobility for the eyelashes, by making it possible more readily to prevent, if so desired, the branches formed from crossing other eyelashes.

The or each cavity may thus comprise at least one Y-shaped unit, and especially may be constituted by only one Y-shaped unit. The angle of divergence between the branches of the Y, which form points preferably extending beyond the moulded eyelash, is, for example, between 10° and 60°, better still between 10° and 40°.

In one variant, the or each cavity comprises at least one X-shaped unit, and especially has only one X-shaped unit or only two X-shaped units following each other in the longitudinal direction of the cavity. The X-shaped units of different cavities may join together to form a continuous composition grid extending over several eyelashes; this may tend towards unifying the curvature of the eyelashes.

An X-shaped or Y-shaped unit may, where appropriate, cover several eyelashes in the top view.

The mould may comprise only one X-shaped unit per cavity receiving an eyelash, the crossing of the branches of the X preferably taking place between 1/3 and 2/3 of the length of the cavity, starting from its proximal end.

The or each cavity may be open at its proximal and distal ends.

Besides the cavities for receiving the eyelashes, at least one of the mould parts may comprise a groove extending transversely to the cavities, as detailed later. Such a groove may be useful for moulding a strip of composition connecting the eyelashes together, and thus unifying their curvature. Such a groove may also be useful for moulding a strip of composition serving as a support for additional added fibres.

The cavities may have proximal ends that are located along a curvilinear baseline, which is concave towards the proximal edge of the mould, i.e. towards the user, and the abovementioned groove may be of curvilinear longitudinal axis which is also concave towards the proximal edge of the mould.

The longitudinal axis of the groove is preferably closer to the proximal end of the cavities that it crosses than their distal end.

The groove may thus be less than 2 mm away from the proximal edge of the mould, better still less than 1 mm. The groove may make it possible to mould a strip of composition giving a liner appearance on the eyelid or the eyebrow arch.

The branches formed by the same cavity may be separated at their distal end by a distance of between 0.5 and 3 mm, this distance being measured from edge to edge.

The shape and/or spacing between the cavities may vary along a baseline from which the cavities extend, as detailed later. This makes it possible to produce an evolutive makeup. The number of branches per cavity receiving the fibres may thus vary along the baseline.

A subject of the invention is also a process for making up the eyelashes, comprising the step consisting in:

moulding the composition on the eyelashes using an assembly as defined above.

Evolutive Makeup

According to a second of its aspects, which may or may not be combined with the first, a subject of the invention is also an assembly comprising:

at least one composition for the cosmetic treatment of keratin fibres, especially eyelashes or eyebrows, and a device comprising a mould comprising a plurality of cavities distributed along a baseline and extending generally transversely to this baseline towards the exterior, into each of which cavities at least one of said fibres may be at least partially introduced, so that the composition is moulded on at least part of the fibres present in the corresponding cavities, the shape and/or spacing between the cavities varying along said baseline and/or the nature of the composition varying along said baseline.

According to this aspect, the invention makes it possible to produce diversified makeups.

The shape of the cavities may vary along the baseline. The term "shape" encompasses the length or the cross section; for example, two rectilinear cavities of different lengths are considered as being of different shapes.

The spacing between the cavities may vary along the baseline.

The mould may be made so as to form by moulding several zones with patterns of the same type in each zone and patterns that differ from one zone to another. For example, the mould is arranged in zones, with, in each zone, cavities of the same shape, and the cavities have different shapes from one zone to another. There is, for example, a zone in which the cavities are arranged to produce X-shaped patterns and a zone in which they are arranged to produce Y-shaped patterns.

The number of such zones ranges, for example, from 2 to 10.

Along the baseline, the length of the cavities receiving the eyelashes may vary, for example, to produce by moulding parts moulded onto the eyelashes, which are longer in a central region than at the ends.

Along the baseline, the cross section of the cavities on their proximal end side may vary, with, for example, a cross section that passes through a maximum on moving along the baseline from one end to the other.

Along the baseline, the cross section of the cavities at mid-length may vary, with, for example, the cross section of the cavities passing through a maximum on moving along the baseline from one end to the other.

The mould may comprise cavities all of different shapes. As a variant, certain cavities are identical, but at least half of the cavities each receiving at least one eyelash have a different shape. Less than a third, or even a quarter, of the cavities may have different shapes.

In a zone in which the cavities are identical, when such a zone exists, it is possible to have the ratio $n_i/N$, in which $n_i$ is the number of identical cavities and N is the total number of cavities, satisfying the relationship $1/10<n_i/N<9/10$, better still $1/10<n_i/N<1/3$.

Along the baseline, the nature of the composition may change. For example, compositions of different colours are moulded in distinct zones of the mould.

Concave Strip of Composition

Many people lament the fact that they have shaggy eyelash fringes. The term "shaggy" means that the eyelashes are sparingly or not at all aligned, some of them not laying at the expected angle.

This phenomenon is aesthetically unappealing, and there are no solutions other than to try and comb them. If the situation is limited to a few undisciplined eyelashes, the application of a mascara may limit the problem. However, mascara tends to lose its efficacy in the course of the day, causing a return to the shaggy effect. Furthermore, this solution is not suited to the situation where many eyelashes are undisciplined. The result in this case tends to be worse than before, since the application of mascara creates numerous groupings.

According to a third aspect, which may or may not be combined with each of the first two, the invention is directed towards solving this problem, and the subject thereof is an assembly comprising:

at least one cosmetic composition for the cosmetic treatment of eyelashes or eyebrows, and a device comprising a mould comprising two mould parts to be closed on the eyelashes, at least one of these parts having a concave groove, which is especially curvilinear, allowing the formation of a strip of composition connecting at least part of the eyelashes along the eyelid or the eyebrow arch.

The groove is concave towards the proximal edge of the mould.

Such a strip makes it possible to fasten the eyelashes together and thus tends to unify their curvature. It may also make it possible to modify the natural orientation of the eyelashes if, during moulding, the eyelashes are constrained to take a certain orientation and if removal from the mould takes place once the strip has cooled sufficiently to conserve its cohesion.

The device may comprise cavities in which the eyelashes engage and which constrain the eyelashes to take a certain orientation during the moulding of the strip.

The moulding of the strip of composition on the eyelashes may take place after combing the eyelashes, where appropriate.

The groove may have a constant width along its longitudinal axis; as a variant, the width of the groove varies, to form a strip of variable width.

The width of the groove may especially decrease gradually towards one end which corresponds to the inner corner of the eye, or on the contrary to the exterior of the eye. A larger width to the exterior of the eye gives a particularly desired aesthetic effect.

The depth of the groove may be constant along its longitudinal axis; as a variant, the depth of the groove varies along its longitudinal axis. A greater depth to the exterior of the eye may also be desirable in aesthetic terms.

The distance from the groove to the proximal edge of the mould, i.e. that turned towards the eyelid or the eyebrow arch at the time of use, may be relatively small, so that the strip gives a liner aspect on the eyelid or the eyebrow arch.

The distance from the groove to the proximal edge may thus be less than or equal to 2 mm, better still 1 mm.

The longitudinal axis of the groove may have a constant or variable curvature.

The longitudinal axis of the groove may be without any straight segment, or, as a variant, may be curvilinear in portions or concave due to a succession of relatively short straight segments, the orientations of which differ so as to give a concave appearance towards the proximal edge of the mould, for example at least 25 such segments, for example 30 segments.

The groove may be unique. As a variant, each mould part comprises several grooves which are, for example, concentric. There are, for example, several substantially parallel grooves that are distant from each other, the width of which decreases from one strip to another, towards the free end of the eyelashes.

The groove is preferably arranged to allow the formation of a continuous strip of composition over the entire eyelash fringe; as a variant, the groove is interrupted, for example at mid-length, and the groove may also extend over only half of the fringe, for example to give a liner effect only on the exterior of the eye.

The length of the strip formed on the eyelashes preferably corresponds substantially to the length of the eyelash fringe. The length of the strip is preferably greater than or equal to 20 mm.

Where appropriate, the groove may extend along a curvilinear median axis that is concave towards the proximal edge of the mould, undulating along this median axis, sinusoidally or in zigzag manner, and create novel aesthetic effects.

The mould may be free of other moulding cavities. As a variant, the mould comprises, besides the groove serving for moulding the strip of composition, at least one additional cavity intended to receive an eyelash for moulding the composition thereon, especially a cavity as defined above, having at least one branching.

The mould may thus comprise cavities for moulding the eyelashes as described elsewhere in the present document.

In the presence of such cavities, the groove may intersect them so that, for each cavity, the intersection takes place substantially at the same distance from the proximal end of the cavity. As a variant, this distance changes from one cavity to another.

The maximum depth of the groove on the corresponding mould part may be the same as that of the imprints corresponding to the cavities on this same mould part; as a variant, it is different, the groove being, for example, deeper than the imprints intended to form the cavities for receiving the eyelashes. This makes it possible to have a pronounced liner effect while at the same time maintaining eyelash fineness.

In the presence of eyelash moulding cavities, it is possible for them to not have a proximal end opening onto the proximal edge of the mould; the cavities may then open into the groove, which preferably extends as indicated above a short distance from the proximal edge of the mould, along said mould, for example a distance representing half the width of the groove.

The depth of the imprints intended for forming the eyelash moulding cavities may decrease on going towards the distal edge of the mould, onto which the cavities may open.

Preferably, the longitudinal ends of the groove are closed, i.e. the groove does not open at its ends to the exterior of the mould.

The longitudinal axis of the groove preferably extends in a plane.

The maximum width of the strip formed is, for example, between 0.15 and 3 mm and the thickness of the strip formed is preferably between 0.2 and 2 mm. The mould may serve for manufacturing an article comprising a moulded strip, obtained by means of the abovementioned groove, and, where appropriate, the fibres supported by this strip.

Article to be Applied to the Eyelashes

Such an article comprises a preformed strip which may be applied to the eyelashes by fixing the strip onto the eyelashes, for example by melting it in the case of using a hot-melt composition to manufacture the strip.

The preformed strip is preferably concave, especially in a plane, so as to follow the curvature of the eyelid. The strip is preferably curvilinear.

The preformed strip may or may not comprise fibres chosen to have the same appearance as the eyelashes of the person using the article, which makes it possible to give the impression of fuller eyelashes or eyebrows.

The fibres may be fixed to the strip while being oriented substantially perpendicular thereto. The fibres may extend on only one side of the strip, their end being located therein or thereon.

To make the article, the mould described above may be used, placing the additional fibres inside the cavities for receiving the eyelashes and filling the groove with the composition, the fibres projecting into the groove. After removing from the mould, a strip is formed, which holds the fibres.

A subject of the invention is thus also an article to be applied to the eyelashes or the eyebrows, comprising a strip of composition to be applied to the eyelashes or the eyebrows.

Preferably, the composition is a hot-melt composition, which makes it possible to fix the strip onto the eyelashes by at least partially melting it, for example by pressing it onto the eyelashes using two jaws brought together, at least one of which is heated to a temperature sufficient to bring about at least partial melting of the strip.

It is possible for the article to be constituted only of the strip of composition to be applied to the eyelashes or eyebrows.

As a variant, the article is constituted by the strip and by fibres borne by the strip, preferably oriented substantially perpendicular thereto.

Preferably, the strip then bears between 10 and 120 fibres.

Preferably, the strip is concave towards the eyelid or the eyebrow arch, so as, for example, to follow the contour of the eyelid. It is preferably curvilinear, but may be rectilinear in portions.

The radius of curvature of the strip may be between 15 and 60 mm.

The length of the strip of the article may be between 10 and 60 mm, and its width between 0.2 and 3 mm.

The fibres borne by the strip may have a length of between 5 and 30 mm.

A subject of the invention is also an assembly comprising, especially inside the same package:

- an article as defined above, in the form of a strip of composition alone or a strip of composition bearing fibres, and
- a device for fixing the strip to the eyelashes or eyebrows, comprising two jaws that are movable relative to each other, which may be brought together to press the article against the eyelashes. At least one of the jaws advantageously comprises heating means to bring the strip to a temperature above its melting point, when the strip is made of a hot-melt material.

These heating means comprise, for example, a heating resistance, at least one lamp emitting in the infrared range or microwave means.

Treatment Process by Applying a Strip of Composition Connecting the Eyelashes Together A subject of the invention is also a process for treating eyelashes or eyebrows, in which:

- at least one concave strip, especially a curvilinear strip, of composition which connects the eyelashes together, especially by being oriented transversely thereto, is applied to the eyelashes, with the aid of an applicator device, especially an applicator device comprising two jaws to be tightened on the eyelashes.

This strip is preferably formed by a hot-melt composition, especially as defined later.

The strip may belong to an article as defined above, being preformed and fixed onto the eyelashes by being melted on contact therewith, or may be formed in situ on the eyelashes with the aid of a device comprising a mould, at least one of the parts of which comprises a groove for forming the strip, as defined above.

When the strip is preformed, a device as defined above may be used to make it, at least one of the mould parts of which comprises a non-rectilinear groove.

When the strip is formed in situ, depositing a molten composition at the base of the eyelashes by means of an applicator device makes it possible, after the application and setting of the composition on cooling, to block the eyelash fringe in a given position.

According to one variant of the process:

- the eyelashes are combed, and then
- the strip of hot-melt composition is applied, preferably taking care not to modify the orientation of the eyelashes.

According to another variant, the molten composition is applied to the eyelashes, or is melted on contact with the eyelashes, which are combed before cooling and setting of the composition.

According to another variant, means arranged to align the eyelashes during the operation for applying the composition and cooling it are used. It is possible, for example, to subject the eyelashes to the action of a comb and/or vibrations to align them.

This aspect of the invention applies to situations other than the treatment of shaggy eyelashes.

The process may be performed, for example, to modify the angle of implantation of the eyelashes, over the entire fringe, or over only a part, for example the outer edge, to create visual effects. To do this, a stream of air may be delivered or another force may be applied from the top downwards, or conversely, or from the side (sweeping), before the composition sets to a solid. The advantage is that the eyelashes can be made more visible without having to change the general curvature of the eyelash or the length of the fibre. An apparent change in the angle of implantation of the eyelashes may be obtained in this way.

A comb may also be used to separate the eyelashes and give the eyelash fringe a greater span. To do this, a comb that is capable of separating the eyelashes may be used, such as a comb whose teeth are mobile and designed to move away from each other after introduction between the eyelashes. Thus, in one variant of the process, the eyelashes are separated and are held separated by introducing the composition strip.

It is also possible to perform the application of the composition and then, after cooling, to perform a new heating step so as to melt the composition and be able to modify the orientation of the eyelashes. This is useful if the initial result is unsatisfactory or if it is desired to modify it in the course of the day.

The application of the composition may take place via the underneath of the eyelash fringe or via the top, or both sides. Application of the composition via the top takes place, for example, using a mould for which only the upper part comprises the groove for forming the strip. Application of the composition via the underneath takes place with a mould for which only the lower part comprises said groove.

Application of the composition via the top and the underneath takes place with a mould for which the upper and lower parts each comprise a groove, the two grooves preferably superposing at least partially, better still exactly, when the mould is closed on the eyelashes.

The composition strip may be black in colour, which makes it possible to obtain a liner effect, or flesh colour, especially of the same colour as that of the person's skin, so as to correct the perceived shape of the eye, especially in the case of eyes that are too open. In this case, the composition strip is applied as close as possible to the eyelid.

For example, the strip is applied at least 2 mm from the eyelid, better still at least 1 mm. The composition strip may also be white in colour to give the illusion of a more open eye.

Process for Moulding the Hot-Melt Composition

Moulding around the eyelashes using a hot-melt composition, such as that defined later, the melting point of which is between 40° C. and 120° C., requires a mould formed from two parts, and a composition that is capable of changing state according to the temperature: fluid at a temperature above its melting point, solid at room temperature.

Thus, the eyelash fringe may be positioned between the two parts of the mould containing the composition in molten form, followed by pressing the mould, waiting for the temperature to fall and removing the mould.

However, this process may pose implementation difficulties:

1) either the composition is heated without heating the mould. This solution functions, but requires good dexterity to rapidly position the mould parts before the composition cools;
2) or the mould is heated so that it transfers heat to the composition to melt it. This approach functions, but poses problems of migration of material. Specifically, it is inevitable that the user will take a certain amount of time to position the mould. In so doing, he may take close to one minute to bring the device close, the two mould parts being separated at this time, and then to position it so that the eyelashes insert between the two mould parts. In general, he needs to check the correct positioning once more. This checking also takes time. Thus, a change in the meltable composition is observed during this approach and this checking. In particular, the composition may migrate, forming surpluses in certain places in the mould and shortages in other places. Furthermore, during the positioning, it is difficult to not touch the skin, or the tip of the eyelashes, in particular if they are shaggy, or the base of the eyelashes. The user generally realises and corrects its position. However, staining or impairment of the natural shape of the eyelashes or undesired grouping of eyelashes is occasionally observed.

This problem may be solved by not starting the heating until after the mould parts have been appropriately positioned and tightened. However, this solution is not entirely satisfactory aesthetically. It is seen that mouldings may form on eyelashes that are not correctly positioned. There may be a risk of moulding on a network of eyelashes that may be intercrossed. To limit this problem, the eyelashes with the composition may be combed beforehand, but it is observed that the positioning operation inevitably causes certain contacts between the device and the eyelashes, thus undoing the combing effect.

There is thus a problem to be solved.

According to a fourth aspect, which may or may not be combined with each of the preceding ones, in so far as a hot-melt composition is used, the invention is directed towards finding a moulding process and device that allow comfortable positioning of the eyelashes and an aesthetic moulding result, in particular with eyelashes that are relatively ordered in the moulding.

According to a fourth of its aspects, a subject of the invention is thus also a cosmetic process for treating keratin fibres, especially eyelashes or eyebrows, using a mould in two parts between which the fibres are positioned, the two mould parts defining at least one cavity containing a hot-melt cosmetic composition and into which at least one of the fibres is at least partially introduced, at least one of said mould parts being provided with heating means, this process comprising the steps consisting in:

a) heating the composition beyond its melting point using the heating means,
b) stopping the heating of the composition,
c) bringing the two mould parts together to mould the composition onto said at least one fibre.

The following are provided by means of this aspect of the invention:

1) comfortable positioning of the device, without the risk of loosening,
2) no problem of migration of the composition and thus a uniform moulding result; and
3) a moulding result in which the eyelashes are correctly aligned.

This alignment appears due to the fact that when the composition comes into contact with the eyelashes, it is sufficiently molten to bring about a capillary force effect which tends to align the eyelashes, without, however, giving them time to form groupings or loosening effects.

The temperature $T_1$ to which the composition is heated beyond its melting point $T_m$ is, for example, such that $T_1-T_m \geq 5°$ C., better still $T_1-T_m \geq 10°$ C.

The result may be further improved by using a mechanical force at the time of contact between the eyelashes and the mould parts, such as a transverse, longitudinal or vertical shear.

The process may thus comprise the step consisting in subjecting the eyelashes to vibrations while the composition is in contact with them in molten form.

The resulting vibrations and oscillations may have the effect of further improving the alignment of the eyelashes and thus the final aesthetic result.

The oscillations may be brought about manually or via a mechanical system such as a vibrator, subjecting only one or both of the mould parts to vibrations, the frequency of the vibrations preferably being between 50 and 125 Hz and the amplitude between 0.2 and 0.4 mm, especially 100 Hz and 0.3 mm.

Accelerated cooling of the composition may also be brought about once the contact between the mould parts and the eyelashes is made.

It may especially be sought to make it such that the rate of cooling of the composition after closing the mould is greater than or equal to 0.3° $C._s^{-1}$.

To do this, an element of Peltier type may be used.

Operations a), b) and c) above, optionally with an intermediate lag time and/or a shear operation and/or a cooling operation, and the operation for separating the mould parts, may be performed with control of the heating and/or cooling means, and optionally of the closure and opening of the mould, automatically by means of an electronic circuit. Thus, a single triggering by the user at the start of the operations will bring about the sequential execution of these actions.

Before step a) above, the mould parts may be preheated to a temperature below the melting point of the composition; for example, before introducing the composition, the mould parts may be maintained at a temperature $T_m$ with $T_f-T_m \leq 5°$ C. in which $T_m$ denotes the preheating temperature and $T_f$ the melting point.

The moulding device used may comprise an internal temperature sensor for determining the temperature of the composition.

The heating and/or cooling means may be integrated into only one of the mould parts, preferably the lower part, or into both the mould parts.

In one example, the lower mould part comprises the heating means and the upper mould part comprises the cooling means.

The heating means may comprise an electrical resistance, or a source of infrared or microwave radiation. Preferably, these heating means are indissociable from at least one of the jaws of the device.

Another subject of the invention is an assembly for treating keratin fibres, especially eyelashes or eyebrows, for performing the above process, comprising:

a hot-melt cosmetic composition, a treatment device comprising two mould parts between which the fibres may be positioned, said parts defining at least one mould cavity into which at least one of the fibres may be introduced at least partially for the moulding of a composition onto the fibre, means for heating at least one of said mould parts, to bring the composition to a temperature above its melting point prior to the closure of the mould on the fibre(s), control means for controlling the heating means so as to deactivate them automatically before closing the mould or at the time of closure of the mould. These control means comprise, for example, a microprocessor or microcontroller card or a programmable or analogue logic network card.

Preferably, the heating means are deactivated before closing the mould, so that the mould part containing the composition begins to cool before closure of the mould, but with cooling of the composition that is still insufficient for it to solidify.

The closure of the mould takes place, for example, in less than 2 seconds.

The mould parts may be made of elastomer, especially of silicone, and may be borne by metal plates, especially aluminium plates.

The heating means may comprise a heating resistance.

The device may comprise a vibrator, to subject at least one of the mould parts to vibrations at the moment when the composition is still fluid.

The stopping and starting of the vibrator may be controlled automatically by the device as a function of the temperature. In particular, the stopping of the vibrator may be automatic once the temperature of the composition falls below a temperature $T_e$ with $T_e=T_m+5°$ C., in which $T_m$ denotes the melting point of the composition at 1 atm.

The device may comprise a Peltier-effect element to accelerate the cooling once the heating means have been deactivated. Where appropriate, the heating means comprise the Peltier element, through which passes a current contrary to that causing the cooling.

The device may comprise an electrical contactor actuated during the closure of the mould and/or at the start of the movement for bringing together the mould parts from an initial position of introduction of the eyelashes therebetween. The change of state of this contactor may be used to deactivate the heating means.

The mould parts may be impelled to separate, by elastic return means.

The device may comprise an electronic circuit for performing the sequence of operations of heating and stoppage of the heating automatically, and also optionally the closing or opening of the mould and/or the activation of the cooling means, for example with a Peltier element. This electronic circuit may be a microprocessor or microcontroller circuit or a programmable or analogue logic network circuit.

I. Treated Keratin Fibres

The keratin fibres to which the invention applies according to any one of its aspects detailed above are preferably human keratin fibres, in particular eyelashes or eyebrows, more preferably eyelashes.

The keratin fibres may be hair. It is thus possible to treat the hair, in particular on a part of the length thereof, for instance the roots, in order to increase the rigidity thereof, and/or the ends in order to improve the appearance thereof.

It is possible to post-treat the keratin fibres, moulded according to the invention, with other products, for example mascara, or by contact with a hot surface.

Each of said fibres may be at least partially introduced into a respective mould cavity. At least two of said fibres may be at least partially introduced into the same cavity. At least one cavity may contain just one fibre.

When the cavities have branchings (first aspect of the invention), and/or to prepare evolutive makeup (second aspect of the invention), and/or to perform the moulding process (fourth aspect of the invention), the composition may be deposited onto at least three-quarters of the length of at least one of said fibres, better still onto at least three-quarters of the length of each of said fibres.

The length of a fibre is measured from the surface of the skin up to its free end when the fibre is laid flat.

The composition may be deposited onto just one part of the length of at least one of said fibres, better still on just one part of the length of each of said fibres.

II. Mould

The moulding of the composition, at least according to the first, second and fourth aspects of the invention, or even according to the third aspect, is performed in situ in the mould, and the moulding allows the forming of the composition.

Each mould part may comprise one or more imprints, which each at least partially define a mould cavity or the abovementioned groove serving for preparing the composition strip that connects the eyelashes. Preferably, the mould is not limited to a single cavity.

The mould may comprise at least two parts each comprising one or more imprints, the imprint(s) of one of the parts being placed opposite the imprint(s) of at least one other part, so as to form all the reinforcements necessary for moulding the composition when the mould parts are brought together.

The mould may comprise at least two parts, one part comprising one or more imprints, each of the imprints being in particular, over at least part of its length, of semicircular cross section, the other part being free of imprint, so as to form the cavity or cavities of the mould when the mould parts are brought together. Such a mould has the advantage of not requiring a great deal of precision when placing the two parts of the mould opposite each other to form the cavities.

The imprints may be arranged in a fan on the corresponding mould part, to receive the eyelashes of a fringe.

The imprints may be arranged along only one part of the mould, especially at the front thereof, i.e. on the proximal side where the keratin fibres to be treated are introduced.

The mould may or may not be disposable.

The surface state of the mould may be smooth to give the composition, once moulded, a smooth external surface and a glossy appearance.

There can not be any relative speed between the keratin fibres and the cavities during the moulding, for example for a period required for the hardening or the drying of the composition, for example a period of 10 to 60 seconds. As a variant, as explained above, the mould is exposed to vibrations while the composition is fluid.

III. Mould Cavities

The volume of the cavity or cavities receiving the fibres to be treated may exceed by a factor of at least 2 and better still by a factor of 10 to 100 the volume of the part of these fibres filling them.

The cavity or cavities may each have, over at least part of their length, a circular, semicircular, oval or polygonal cross section, which may or may not be constant when moving along the cavity.

The cavity or cavities may comprise portions of substantially cylindrical or conical shape.

The cavity or cavities may each be, over at least a portion of their length, of decreasing cross section so as to give a tapered aspect to the fibre(s) once moulded by the composition.

The cavity or cavities may each have a length of between 5 and 30 mm and a width at the inlet, especially a diameter, of between 150 μm and 3 mm.

Each cavity may have a curvilinear elongated shape so as substantially to reproduce the curvature of the eyelashes introduced therein. Each cavity may on the contrary have an elongated shape that does not reproduce the curvature of the eyelashes, especially being of rectilinear longitudinal axis or in a broken line (for at least the second and fourth aspects of the invention).

Each cavity may have an elongated shape and be closed at at least one of its longitudinal ends.

Each cavity may constitute a space that is substantially entirely closed, in the absence of keratin fibre. In this case, one part of each keratin fibre at least partially introduced into a cavity may be gripped between the two parts of the mould that are brought together, while another part of the keratin fibre extends into the cavity. The cavity may be closed on the side where the keratin fibre(s) are introduced, via a flexible wall, which can deform, preferably elastically, so as to allow the keratin fibre(s) to pass into the cavity.

As a variant, each cavity may constitute a semi-open space, in the absence of keratin fibre. In particular, each cavity may delimit a space that is closed with the exception of one end via which the keratin fibre(s) that are at least partially introduced into the cavity communicate with the exterior. Thus, each cavity may open to the exterior, on the side where the keratin fibre(s) are introduced, via an opening through which the keratin fibre(s) are introduced.

At least two of the cavities may be not connected. All of the cavities may be not connected.

The cavities may or may not be parallel to one another.

The cavities may be placed at regular intervals, for example according to a step of 1 to 2 mm, centre to centre.

The number of cavities may be greater than or equal to six, more preferably greater than or equal to ten.

IV. Jaws

The cavity or cavities may be formed by bringing two jaws together, in particular via a translational and/or rotational movement of one of the jaws relative to the other.

The two jaws may be moved apart at the moment the keratin fibres are introduced and closed again so as to form the cavities into which the keratin fibres are introduced.

The jaws may carry or integrate the mould.

The jaws may be curved, in particular about a geometrical axis perpendicular to the longitudinal axis of the mould cavities receiving the eyelashes.

A device in which one or both of the jaws slide on columns, or a device in which one of the jaws is borne by a slide rail, may be used to move the two jaws apart at the moment the keratin fibres are introduced and to close them again so as to form the cavities.

Use may also be made of a device in which the jaws are connected by a hinge.

Preferably, the jaws are brought together via a translational movement, at least at the end of the bringing-together movement.

Use may also be made of a system where the jaws are not connected, and are optionally associated with one another by a guide system.

The two jaws with the corresponding mould parts preferably fit together sufficiently well for the composition present in the cavities not to escape.

The jaws may comprise mould parts made of an elastomeric material, for example in order to absorb a deformation of the mould.

V. Mould Deformation

It may be advantageous to deform the mould with the keratin fibres in place in order to reduce the volume of the cavities, and for example to force the composition to be distributed around the fibres introduced into the cavities.

The mould may comprise a flexible material, in particular a plastic, especially an elastomeric material.

An extensible, in particular elastomeric, mould makes it possible to compress the composition in order to avoid problems of dead volume and/or to force better integration of the fibres into the composition. The mould may be entirely made of flexible material, in particular plastic, especially elastomeric material.

The mould may comprise flexible parts and non-flexible parts. The mould may in particular be surface-covered with flexible, in particular elastomeric, material, for example over a thickness ranging from 0.5 to 2 mm.

The deformation of the mould may be carried out by compression, for example mechanical compression with fingers, or be pneumatic or hydraulic, or by suction. For example, by pulling a trigger, an overpressure can be created between one jaw and the mould, which has the effect of compressing the two parts of the mould onto each other and preventing dead zones.

VI. Demoulding

The composition may be demoulded, extracted from the mould, preferably without losing its cohesion around the keratin fibres and while retaining the surface finish imparted by the mould.

Demoulding of the composition without deterioration is desired.

The mould may be extensible, in particular elastomeric, in order to facilitate demoulding.

The cavity or cavities of the mould may have a non-stick coating or may have undergone a treatment aimed at giving non-stick properties. Thus, the mould parts may comprise at the surface a low-adhesion material, in particular of silicone or PTFE type. A layer of a non-stick product, in particular an oil, a silicone, a PTFE powder or boron nitride, may also be applied to the mould cavity or cavities.

The device may comprise an automatic or non-automatic demoulding system in order to act on the mould and/or the composition contained in the cavity or cavities in order to facilitate the separation of the composition-coated fibres from the mould. This demoulding system may comprise a set of small blades or other reliefs which deform the mould by being compressed against said mould. The deformation of the mould may take place in the cavities, thereby facilitating the ejection of the moulded material.

Bridges of composition may connect several cavities to one another after moulding, in an unwanted manner. The device may comprise blades or other reliefs serving to cut composition bridges between at least two cavities after moulding, especially for the first, second and fourth aspects of the invention. These blades or other reliefs may act by being applied on the bridges between the cavities. These blades may be added to the mould.

The blades or other reliefs that serve to cut the composition bridges may be borne by one of the jaws. In this case, the other jaw may have a planar surface from the viewpoint of the blade or other relief or a groove into which the blade or other relief engages. The blades or other reliefs may further be placed on the two jaws, in such a way that one blade or other relief of one of the jaws applies on one blade or other relief of the other jaw.

The demoulding of the moulded composition is preferably performed mechanically, in particular by deformation of the mould, by moving the two jaws away from each other and/or by pulling the keratin fibres out of the mould.

The demoulding of the composition may be performed, where appropriate, by pulling at one end of one part of the mould in order to separate it from the other part, in the way in which two sheets adhering to each other are separated by peeling. The demoulding of the moulded composition may further, according to one variant, be at least partly performed physicochemically, in particular by at least partially dissolving, with a solvent, the mould or a film-coating present inside the mould, between said mould and the composition moulded onto the keratin fibres.

VII. Provision of the Composition

In the case especially in which a non-hot-melt composition is used to perform the invention according to one of the first, second and third aspects, at least part of the composition, especially all the composition, may be deposited on at least one of said fibres, better still on each of said fibres, before they are introduced into the mould. In this case, the closing of the mould can distribute the composition in the cavities and, where appropriate, drive the excess composition out of the mould.

Especially during the use of a hot-melt composition, at least part of the composition, in particular all the composition, may be initially present in the mould before introduction of the fibre(s) into the mould. This can facilitate the metering of the composition introduced into the mould cavity or cavities.

The composition may be contained with the mould in leaktight packaging, where appropriate.

At least part of the composition, in particular all the composition, may be injected into the mould, via at least one injection channel.

The mould may comprise mould parts with imprints in which at least part of the composition, in particular all the composition, is present before introduction of the keratin fibre(s) into the mould. The imprints define the mould cavities when said mould is closed.

The mould may comprise at least two parts each comprising imprints, at least part of the composition, in particular all the composition, being present in at least one part, in particular in all the parts, of the mould, before introduction of the keratin fibre(s) into the mould. The composition for example entirely fills the imprints and is present only in the imprints, before closing the mould.

The mould may also be prefilled with an excess of the composition so that the material stands higher than the cavity, for example by being slightly curved. In this way, any absence of product around the eyelash is avoided and the formation of a perfect moulding is ensured.

VIII. Automation

The functioning of the moulding device may be automated, as indicated previously. A single triggering may make it possible to perform a series of operations, for example filling the cavities with the moulding composition, and an action exerted on the mould so as to deform it in order to perform the demoulding. The closing of the mould may also be automatic.

IX. Device

As already indicated, the device used for performing the invention according to any one of its four aspects may comprise at least one heating element used to increase the temperature of the composition. Increasing the temperature may induce a change of state of the composition, especially passing from the solid state to the liquid state by melting, or, for at least the first and second aspects of the invention, when the composition used is not a hot-melt composition, solidification of the composition, or alternatively an increase in the reactivity of the composition.

For the first and second aspects of the invention especially, during the temperature increase, the composition may be present in the mould or outside the mould. The composition may be present outside the mould during the increase in temperature of the mould and may be injected in the liquid state into the mould, especially via at least one injection channel. The heating may also be automatically triggered upon closure of the mould. As a variant, the heating may be triggered before closure of the mould and a visual and/or sound indicator may signal to the user that the desired temperature for closing the mould and/or putting the fibres in place has been reached.

In particular when the composition is not a hot-melt composition, the device may comprise at least one evaporation system for evaporating a solvent. This may be a heating element and/or a suitable ventilation.

The device may comprise at least one system for admitting material used for introducing part or all of the composition into the mould cavity or cavities, especially comprising one or more injection channels communicating with one or more mould cavities. The composition is, for example, contained in a reservoir, and a piston or a pump makes it possible to force it to flow into the mould cavity or cavities.

The device may comprise at least one light element, in particular IR, UV or visible light element, or microwave element, which serves in particular to increase the temperature of the composition, in particular by absorption of the light or microwave radiation by the cosmetic composition.

The jaws may be closed manually.

The device may be in the form of a clamp comprising at least one housing into which at least one of the fingers of one hand, for example the thumb or the index finger, can be introduced so as to move the two jaws apart, in order to make it possible to introduce the keratin fibres and to close them on said fibres.

The device may be in the form of a clamp comprising two housings into which two of the fingers of one hand, for example the thumb and the index finger, can be introduced so as to move the two jaws apart, in order to make it possible to introduce the keratin fibres and to close them on said fibres. Each of these housings may be removable or non-removable. It may or may not be possible for each of these housings to be oriented rotationally.

The composition is preferably a hot-melt composition.

Also preferably, the device used for moulding the composition allows the moulding process according to the fourth aspect of the invention, detailed above, to be performed.

The device thus preferably comprises two jaws that may be brought together, at least one of which incorporates heating means.

X. Cosmetic Composition

The composition used for moulding the eyelashes and/or for the formation of the abovementioned strip is a cosmetic composition. It may be removed from the keratin fibres, onto which it has been applied, via conventional makeup-removing processes, for example by applying water, in particular warm water.

A. Hot-Melt Composition with a Melting Point of Between 40° C. and 120° C.

When the cosmetic composition used according to one of the four aspects of the invention is a hot-melt composition, which is most particularly preferred, it preferably has a melting point of between 40° C. and 120° C., and comprises at least 15% by weight of meltable compound(s), relative to the total weight of the composition.

In particular, such a composition is brought during moulding to a temperature greater than or equal to its melting point $T_m$.

In particular, the cosmetic composition may have a melting point of between 40° C. and 100° C., preferably between 45° C. and 85° C.

Within the context of the invention, the melting point corresponds to the temperature of the most endothermic peak observed in thermal analysis (DSC) as described in the standard ISO 11357-3: 1999. The melting point may be measured using a differential scanning calorimeter (DSC), for example the calorimeter sold under the name DSC Q2000 by the company TA Instruments.

The measuring protocol is as follows:

A 5 mg sample placed in a crucible is subjected to a first temperature rise ranging from −20° C. to 120° C., at a heating rate of 10° C./minute, it is then cooled from 120° C. to −20° C. at a cooling rate of 10° C./minute and it is finally subjected to a second temperature rise ranging from −20° C. to 120° C. at a heating rate of 5° C./minute. During the second temperature rise, the following parameters are measured:

the melting point ($T_m$) of the sample, corresponding to the temperature of the most endothermic peak observed in the melting curve, representing the variation of the difference in power absorbed as a function of the temperature;

ΔHf: the heat of fusion of the sample, corresponding to the integral of the entire melting curve obtained. This heat of fusion of the sample is the amount of energy required to make the compound change from the solid state to the liquid state. It is expressed in J/g.

Such a cosmetic composition may be fluid or solid at 25° C. and at 1 atm.

It may be aqueous or anhydrous, and preferably anhydrous.

It may have a solids content of greater than or equal to 42% by weight, in particular greater than or equal to 45% by weight, or even greater than or equal to 48% by weight, and preferentially greater than or equal to 50% by weight, relative to the total weight of the composition.

For the purposes of the present invention, the "solids content" denotes the content of non-volatile matter.

The solids content (abbreviated as SC) of a composition according to the invention is measured using a Halogen Moisture Analyser HR 73 commercial halogen desiccator from Mettler Toledo. The measurement is performed on the basis of the weight loss of a sample dried by halogen heating, and thus represents the percentage of residual matter once the water and the volatile matter have evaporated off.

This technique is especially described in the apparatus documentation supplied by Mettler Toledo.

The measuring protocol is as follows:

Approximately 2 g of the composition, referred to hereinbelow as the sample, are spread out on a metal crucible, which is placed in the halogen desiccator mentioned above. The sample is then subjected to a temperature of 120° C. until a constant weight is obtained. The wet mass of the sample, corresponding to its initial mass, and the dry mass of the sample, corresponding to its mass after halogen heating, are measured using a precision balance.

The experimental error associated with the measurement is of the order of plus or minus 2%.

The solids content is calculated in the following manner:

$$\text{Solids content(expressed as \% by weight)} = 100 \times (\text{dry mass/wet mass})$$

According to a first embodiment, the cosmetic composition is fluid at room temperature.

For the purposes of the invention, the term "fluid" is intended to characterize the fact that a composition according to the invention is not solid. In other words, it manifests a fluidity sufficient to have flow properties. A composition of mascara type is, for example, representative of this type of fluidity.

In particular, the composition according to the invention may advantageously have a viscosity of less than 100 Pa·s, preferably between 0.1 Pa·s and 50 Pa·s, and better still between 1 Pa·s and 30 Pa·s, at room temperature and pressure, the viscosity being in particular measured using a Rheomat RM100® instrument.

Such a composition may be aqueous or anhydrous.

It may be in the form of oil-in-water emulsions, as is the case for wax-in-water emulsions. It may also be in the form of a dispersion of wax particles in an anhydrous medium, as is the case with a dispersion of wax in isododecane.

According to this first embodiment, the cosmetic composition may comprise from 15% to 60% by weight, preferably from 18% to 55% by weight and even better still from 20% to 50% by weight of meltable compound(s), relative to the total weight of the composition.

According to a second embodiment, which is preferred, the cosmetic composition is solid at room temperature.

For the purposes of the invention, the term "solid" is intended to characterize the fact that a composition according to the invention is not liquid. In other words, it manifests rigidity sufficient to not have flow properties.

The composition may thus advantageously have a viscosity greater than 1000 Pa·s, preferably greater than 10 000 Pa·s, at room temperature and ambient pressure.

Such a composition may be aqueous, in particular in the form of an emulsion of the meltable compound(s) in water, or anhydrous. In particular, it may be in the form of a dispersion of the meltable compound(s) in an organic, preferably volatile, preferentially hydrocarbon-based, solvent.

Such a cosmetic composition is preferably anhydrous.

According to this second embodiment, the cosmetic composition comprises from 40% to 100% by weight, preferably from 60% to 100% by weight and even better still from 80% to 100% by weight of meltable compound(s) relative to the total weight of the composition.

A composition according to the invention may be subjected to heating means before and/or during the application.

These heating means are suitable for melting at least one part of the meltable compound(s) of the cosmetic composition.

The composition may be locally heated to a temperature greater than or equal to 45° C., or even greater than or equal to 50° C., or else greater than or equal to 55° C.

The temperature to which at least part of the composition is heated may be inclusively between 45° C. and 120° C., better still between 45° C. and 85° C.

The temperature may be measured, for example, at the surface using an infrared pyrometer, for example a Fluke® brand machine.

Only the heated composition can come into contact with the keratin fibres, for example the eyelashes, during the application.

It is understood that the temperature of the cosmetic composition must not lead to a risk of burning at the time of application.

Thus, when the composition is heated before application, a waiting time between the moment at which the composition is heated and the application to the keratin materials may optionally be necessary.

According to one embodiment variant, the composition is heated simultaneously with its application to the keratin fibres.

According to another embodiment variant, the composition is heated before and during its application to the keratin fibres.

The total heat of fusion of the composition is the heat consumed by the composition between −20° C. and 120° C. The total heat of fusion of the composition is equal to the area under the curve of the thermogram obtained using a differential scanning calorimeter (DSC), such as the calorimeter sold under the name MDSC 2920 by the company TA Instruments, with a temperature rise of 5° C. or 10° C. per minute, according to standard ISO 11357-3:1999.

The measuring protocol is as follows:

A 5 mg sample of composition is placed in a crucible and then subjected to a first temperature rise ranging from −20° C. to 120° C., at a heating rate of 10° C./minute, and is then cooled from 120° C. to −20° C. at a cooling rate of 10° C./minute. The sample is maintained at −20° C. for 5 minutes and finally subjected to a second temperature rise ranging from −20° C. to 100° C. at a heating rate of 5° C./minute.

During the second temperature rise, the variation in the difference in power absorbed by an empty crucible and by the crucible containing the sample of the composition is measured as a function of the temperature. The melting point of the compound is the temperature value corresponding to the top of the peak of the curve representing the variation in the difference in power absorbed as a function of the temperature.

The heat of fusion of the composition consumed at the temperature Tc is the amount of energy Δh required to make the composition pass from the solid or very viscous state at −20° C. to the state of the composition at the temperature Tc. It is expressed in J/g.

According to one embodiment of the invention, the cosmetic composition is chosen such that, when said composition is heated to the temperature Tc, the ratio of the heat consumed between −20° C. and Tc by the composition to the total heat consumed Δh between −20° C. and 120° C. is greater than 0.4.

This relationship is confirmed, for example, for a temperature Tc of the composition of between 45° C. and 85° C.

The choice of the temperature Tc to which the composition is brought by the heating means may thus be made so that said ratio is greater than or equal to 0.4, for example greater than 0.5. In other words, heating is performed to a temperature such that the ratio of the heat supplied to heat the sample of composition to the temperature Tc to the total heat is greater than or equal to 0.4, such a parameter being measured according to the DSC protocol described above.

The composition in accordance with the invention, when it is a hot-melt composition, is capable of passing from a solid state to an at least partially liquid or preferably even totally liquid state, and of doing so reversibly.

As mentioned above, a composition according to the invention comprises a content of meltable compound(s) of greater than 15% by weight, relative to the total weight of the composition. Preferably, it may have a content of meltable compound(s) ranging from 15% to 100%, better still from 20% to 95% by weight, relative to the total weight of the composition.

For the purposes of the invention, the meltable compound(s) advantageously have a melting point of between 40° C. and 120° C.

Preferably, this (these) compound(s) can be chosen from thermoplastic polymers, waxes, semi-crystalline polymers, and mixtures thereof.

Thus, according to one particular embodiment, said meltable compound(s) may have crystallizable chains.

In this embodiment, the cosmetic composition is then heated to a temperature Tc such that at least part of the crystallizable chains of the meltable compound(s) is at least partially, or even totally, melted. The solid/liquid change of state is thus at least partly due to the melting of a crystalline part of the meltable compound(s).

Preferably, the meltable compound(s) according to the invention are not in the form of a particulate dispersion in a solvent medium.

Thermoplastic Polymer

For the purposes of the present invention, the term "thermoplastic polymer" is intended to mean a polymer which softens when hot and which can be moulded while retaining its shape after cooling.

The thermoplastic polymers that may be used in the context of the present invention are any polymer or copolymer or any blend of polymers and/or copolymers having the property of being thermoplastic.

Among the thermoplastic polymers, mention may in particular be made of polyethylene, polystyrene, polyamides, polyvinyl chloride, polyethylene terephthalate, and mixtures thereof.

Mention may also be made of aliphatic polyesters, and in particular polyhydroxyalkanoates (PHAs), such as poly-3-hydroxybutyrate (PHB), polyhydroxyvalerate (PHV) or polyhydroxyhexanoate (PHH), polylactic acids (PLAs), polybutylene succinates (PBSs), polycaprolactones (PCLs), polyanhydrides, polyvinyl alcohols, and derivatives thereof, acetate esters, such as acetate/polyvinyl (PVAc) copolymer, starch derivatives, polysaccharides, including in particular cellulose derivatives such as cellulose esters, and derivatives thereof, in particular celluloids or cellulose ethers, and mixtures thereof.

In particular, among the cellulose esters, mention may be made of cellulose acetate, cellulose triacetate, cellulose propionate, cellulose acetate propionate, cellulose acetate butyrate, and cellulose sulfate, and mixtures thereof.

Among the cellulose ethers, mention may in particular be made of methylcellulose, ethylcellulose, ethylmethylcellulose, hydroxyethylcellulose, hydroxypropylcellulose (HPC), hydroxyethylmethylcellulose, hydroxypropylmethylcellulose (HPMC), ethylhydroxyethylcellulose, carboxymethylcellulose (CMC), and mixtures thereof.

Among the acetate esters, mention may in particular be made of acetate/polyvinyl copolymers, including in particular ethylene-vinyl acetate (EVA) and derivatives thereof. For example, mention may be made of EVA/ethylcellulose or EVA/starch copolymers.

As thermoplastic polymers that are most particularly suitable for a composition according to the invention, mention may preferably be made of ethylene-vinyl acetate (EVA), sold in particular under the name Evatane 28-800 by the company Arkema.

In a cosmetic composition according to the invention, use may in particular be made of thermoplastic polymers formulated in a mixture, such as the mixture of ethylene-vinyl acetate and paraffin sold under the name Cool Bind 34-1300® by the company National Starch.

Preferably, the film-forming polymers under consideration in the context of the present invention are distinct from particulate dispersions of latex type.

Wax

In a general manner, the term "wax" means a lipophilic compound, which is solid at room temperature (25° C.), with a reversible solid/liquid change of state, which has a melting point of greater than or equal to 30° C., which may be up to 200° C. and especially up to 120° C.

Within the context of the invention, the melting point corresponds to the temperature of the most endothermic peak observed in thermal analysis (DSC) as described in the standard ISO 11357-3: 1999. The melting point of the wax may be measured using a differential scanning calorimeter (DSC), for example the calorimeter sold under the name MDSC 2920 by the company TA Instruments.

The measuring protocol is as follows:

A 5 mg sample of wax placed in a crucible is subjected to a first temperature rise from −20° C. to 100° C., at a heating rate of 10° C./minute, and then is cooled from 100° C. to −20° C. at a cooling rate of 10° C./minute and is finally subjected to a second temperature rise ranging from −20° C. to 100° C. at a heating rate of 5° C./minute. During the second temperature rise, the variation in the difference in power absorbed by the empty crucible and by the crucible containing the sample of wax is measured as a function of the temperature. The melting point of the compound is the temperature value corresponding to the top of the peak of the curve representing the variation in the difference in power absorbed as a function of the temperature.

The waxes that may be used in the compositions according to the invention are chosen from waxes that are solid at room temperature, of animal, plant, mineral or synthetic origin, and mixtures thereof.

The waxes, for the purposes of the invention, may be those generally used in the cosmetic or dermatological fields. They may in particular be polar or apolar, and hydrocarbon-based, silicone and/or fluoro waxes, optionally comprising ester or hydroxyl functions. They may also be of natural or synthetic origin.

a) Apolar Waxes

For the purposes of the present invention, the term "apolar wax" means a wax whose solubility parameter at 25° C. as defined below, $\delta_a$, is equal to 0 (J/cm$^3$).

The definition and calculation of the solubility parameters in the Hansen three-dimensional solubility space are described in the article by C. M. Hansen: *The three-dimensional solubility parameters*, J. Paint Technol. 39, 105 (1967).

According to this Hansen space:

$\delta_D$ characterizes the London dispersion forces derived from the formation of dipoles induced during molecular impacts;

$\delta_p$ characterizes the Debye interaction forces between permanent dipoles and also the Keesom interaction forces between induced dipoles and permanent dipoles;

$\delta_h$ characterizes the specific interaction forces (such as hydrogen bonding, acid/base, donor/acceptor, etc.); and $\delta_a$ is determined by the equation: $\delta_a=(\delta_p^2+\delta_h^2)^{1/2}$.

The parameters $\delta_p$, $\delta_h$, $\delta_D$ and $\delta_a$ are expressed in (J/cm$^3$).

The apolar waxes are in particular hydrocarbon-based waxes formed solely from carbon and hydrogen atoms, and free of heteroatoms such as N, O, Si and P.

The apolar waxes are chosen from microcrystalline waxes, paraffin waxes, ozokerite and polyethylene waxes, and mixtures thereof.

An ozokerite that may be mentioned is Ozokerite Wax SP 1020 P.

As microcrystalline waxes that may be used, mention may be made of Multiwax W 445® sold by the company Sonneborn, Microwax HW® and Base Wax 30540® sold by the company Paramelt, and Cerewax® No. 3 sold by the company Baerlocher.

As microwaxes that may be used in the compositions according to the invention as apolar wax, mention may be made especially of polyethylene microwaxes such as those sold under the names Micropoly 200®, 220®, 220L® and 250S® by the company Micro Powders.

Polyethylene waxes that may be mentioned include Performalene 500-L Polyethylene and Performalene 400 Polyethylene sold by New Phase Technologies, Asensa® SC 211 sold by the company Honeywell.

b) Polar Wax

For the purposes of the present invention, the term "polar wax" means a wax whose solubility parameter at 25° C., δa, is other than 0 (J/cm$^3$).

In particular, the term "polar wax" means a wax whose chemical structure is formed essentially from, or even constituted by, carbon and hydrogen atoms, and comprising at least one highly electronegative heteroatom such as an oxygen, nitrogen, silicon or phosphorus atom.

The polar waxes may in particular be hydrocarbon-based, fluoro or silicone waxes.

Preferentially, the polar waxes may be hydrocarbon-based waxes.

The term "hydrocarbon-based wax" means a wax formed essentially from, or even constituted by, carbon and hydrogen atoms, and optionally oxygen and nitrogen atoms, and that does not contain any silicon or fluorine atoms. It may contain alcohol, ester, ether, carboxylic acid, amine and/or amide groups.

According to the invention, the term "ester wax" means a wax comprising at least one ester function. According to the invention, the term "alcohol wax" means a wax comprising at least one alcohol function, i.e. comprising at least one free hydroxyl (OH) group.

In particular, use may be made, as polar waxes, of those chosen from:

i) waxes of formula $R_1COOR_2$ in which $R_1$ and $R_2$ represent linear, branched or cyclic aliphatic chains in which the number of atoms ranges from 10 to 50, which may contain a heteroatom such as O, N or P and whose melting point ranges from 25 to 120° C.;

ii) bis(1,1,1-trimethylolpropane) tetrastearate, sold under the name Hest 2T-4S® by the company Heterene;

iii) dicarboxylic acid diester waxes of general formula $R^3$—(—OCO—$R^4$—COO—$R^5$), in which $R^3$ and $R^5$ are identical or different, preferably identical, and represent a $C_4$-$C_{30}$ alkyl group (alkyl group comprising from 4 to 30 carbon atoms) and $R^4$ represents a linear or branched $C_4$-$C_{30}$ aliphatic group (alkyl group comprising from 4 to 30 carbon atoms) which may or may not contain one or more unsaturations, and is preferably linear and unsaturated;

iv) mention may also be made of the waxes obtained by catalytic hydrogenation of animal or vegetable oils having linear or branched $C_8$-$C_{32}$ fatty chains, for example such as hydrogenated jojoba oil, hydrogenated sunflower oil, hydrogenated castor oil, hydrogenated coconut oil, and also the waxes obtained by hydrogenation of castor oil esterified with cetyl alcohol;

v) beeswax, synthetic beeswax, polyglycerolated beeswax, camauba wax, candelilla wax, oxypropylenated lanolin wax, rice bran wax, ouricury wax, esparto grass wax, cork fibre wax, sugar cane wax, Japan wax, sumac wax, montan wax, orange wax, laurel wax, hydrogenated jojoba wax, sunflower wax, lemon wax, olive wax or berry wax.

According to another embodiment, the polar wax may be an alcohol wax. According to the invention, the term "alcohol wax" means a wax comprising at least one alcohol function, i.e. comprising at least one free hydroxyl (OH) group. Examples of alcohol waxes that may be mentioned include the $C_{30}$-$C_{50}$ alcohol wax Performacol® 550 Alcohol sold by the company New Phase Technologies, stearyl alcohol and cetyl alcohol.

It is also possible to use silicone waxes, which may advantageously be substituted polysiloxanes, preferably of low melting point.

The term "silicone wax" means an oil comprising at least one silicon atom, and in particular comprising Si—O groups.

Among the commercial silicone waxes of this type, mention may be made in particular of those sold under the names Abilwax 9800, 9801 or 9810 (Goldschmidt), KF910 and KF7002 (Shin-Etsu), or 176-1118-3 and 176-11481 (General Electric).

The silicone waxes that may be used may also be alkyl or alkoxy dimethicones, and also ($C_{20}$-$C_{60}$) alkyl dimethicones, in particular ($C_{30}$-$C_{45}$)alkyl dimethicones, such as the silicone wax sold under the name SF-1642 by the company GE-Bayer Silicones or $C_{30}$-$C_{45}$ alkyl dimethylsilyl polypropylsilsesquioxane under the name SW-8005® C30 Resin Wax sold by the company Dow Corning.

In the context of the present invention, particularly advantageous waxes that may be mentioned include beeswax, for example the product sold under the name White Beeswax SP-453P by the company Strahl & Pitsch, or a paraffin wax.

Semi-Crystalline Polymer

The cosmetic composition according to the invention may comprise at least one semi-crystalline polymer. Preferably, the semi-crystalline polymer has an organic structure, and a melting point of greater than or equal to 30° C.

For the purposes of the invention, the term "semi-crystalline polymer" means polymers comprising a crystallizable part and an amorphous part and having a first-order reversible change of phase temperature, in particular of melting point (solid-liquid transition). The crystallizable part is either a side chain (or pendent chain) or a block in the backbone.

When the crystallizable part of the semi-crystalline polymer is a block of the polymer backbone, this crystallizable block has a chemical nature different from that of the amorphous blocks; in this case, the semi-crystalline polymer is a block copolymer, for example of the diblock, triblock or multiblock type. When the crystallizable part is a chain that is pendent on the backbone, the semi-crystalline polymer may be a homopolymer or a copolymer.

The melting point of the semicrystalline polymer is preferably less than 120° C.

The melting point of the semi-crystalline polymer is preferably greater than or equal to 40° C. and less than 85° C.

The semi-crystalline polymer(s) according to the invention are solid at room temperature (25° C.) and atmospheric pressure (760 mmHg), with a melting point of greater than or equal to 30° C. The melting point values correspond to the melting point measured using a differential scanning calorimeter (DSC), such as the calorimeter sold under the name DSC 30 by the company Mettler, with a temperature rise of 5° C. or 10° C. per minute. The melting point under consideration is the point corresponding to the temperature of the most endothermic peak in the thermogram.

Besides the crystallizable chains or blocks, the blocks of the polymers are amorphous. For the purposes of the invention, the term "crystallizable chain or block" means a chain or block which, if it were alone, would change from the amorphous state to the crystalline state reversibly, depending on whether the temperature is above or below the melting point. For the purposes of the invention, a chain is a group of atoms, which are pendent or lateral relative to the polymer backbone. A block is a group of atoms belonging to the backbone, this group constituting one of the repeating units of the polymer.

The crystallizable blocks or chains of the semi-crystalline polymers may represent at least 30% and better still at least 40% of the total weight of each polymer. The semi-crystalline polymers bearing crystallizable side chains are homopolymers or copolymers. The semi-crystalline polymers of the invention bearing crystallizable blocks are block or multiblock copolymers. They may be obtained by polymerizing a monomer bearing reactive (or ethylenic) double bonds or by polycondensation. When the polymers of the invention are polymers bearing crystallizable side chains, these side chains are advantageously in random or statistical form.

The semi-crystalline polymers of the invention may be of synthetic origin.

In particular, the semi-crystalline polymer may be chosen from:

homopolymers and copolymers comprising units resulting from the polymerization of one or more monomers bearing crystallizable hydrophobic side chain(s), polymers bearing in the backbone at least one crystallizable block, polycondensates of aliphatic or aromatic or aliphatic/aromatic polyester type, copolymers of ethylene and propylene prepared via metallocene catalysis, and acrylate/silicone copolymers.

The semi-crystalline polymers that may be used in the invention may be chosen in particular from:

block copolymers of polyolefins of controlled crystallization, whose monomers are described in EP 0 951 897, polycondensates, in particular of aliphatic or aromatic or aliphatic/aromatic polyester type, copolymers of ethylene and propylene prepared via metallocene catalysis, homopolymers or copolymers bearing at least one crystallizable side chain and homopolymers or copolymers bearing in the backbone at least one crystallizable block, such as those described in document U.S. Pat. No. 5,156,911, such as the ($C_{10}$-$C_{30}$)alkyl polyacrylates corresponding to the Intelimer® products from the company Landec described in the brochure *Intelimer® Polymers*, Landec IP22 (Rev. 4-97), for example the product Intelimer® IPA 13-1 from the company Landec, which is a polystearyl acrylate with a molecular weight of about 145 000 and a melting point of 49° C., homopolymers or copolymers bearing at least one crystallizable side chain, in particular containing fluoro group(s), as described in document WO 01/19333, acrylate/silicone copolymers, such as copolymers of acrylic acid and of stearyl acrylate bearing polydimethylsiloxane grafts, copolymers of stearyl methacrylate bearing polydimethylsiloxane grafts, copolymers of acrylic acid and of stearyl methacrylate bearing polydimethylsiloxane grafts, copolymers of methyl methacrylate, butyl methacrylate, 2-ethylhexyl acrylate and stearyl methacrylate bearing polydimethylsiloxane grafts. Mention may be made in particular of the copolymers sold by the company Shin-Etsu under the names KP-561 (CTFA name: acrylates/dimethicone), KP-541 (CTFA name: acrylates/dimethicone and isopropyl alcohol), KP-545 (CTFA name: acrylates/dimethicone and cyclopentasiloxane), and mixtures thereof.

In the context of the present invention, as particularly advantageous semi-crystalline polymers, mention may be made of poly($C_{10}$-$C_{30}$)alkyl acrylates, for example the product sold under the name Intelimer IPA 13-1 NG by the company Air Products and Chemicals.

Preferably, in the context of the present invention, the meltable compound(s) are chosen from ethylene-vinyl acetate (EVA), a beeswax, a paraffin wax, a poly($C_{10}$-$C_{30}$) alkyl acrylate, a vinyl acetate/allyl stearate copolymer, and mixtures thereof.

In the context of the present invention, mention may in particular be made of vinyl acetate/allyl stearate copolymers, for example the product sold under the name Mexomere PQ by the company Chimex.

Aqueous Phase

The cosmetic composition of an assembly according to the invention may comprise an aqueous phase, which may form a continuous phase of the composition.

The aqueous phase may comprise water. It may also comprise at least one water-soluble solvent.

In the context of the present invention, the term "water-soluble solvent" denotes a compound that is liquid at room temperature and water-miscible.

The water-soluble solvents that may be used in the compositions according to the invention may also be volatile.

Among the water-soluble solvents that may be used in the compositions according to the invention, mention may be made especially of lower monoalcohols containing from 1 to 5 carbon atoms, such as ethanol and isopropanol, glycols containing from 2 to 8 carbon atoms, such as ethylene glycol, propylene glycol, 1,3-butylene glycol and dipropylene glycol.

The aqueous phase, for example composed of water and optionally a water-miscible solvent, is generally present in a composition according to the invention in a content ranging from 30% to 80% by weight, preferably ranging from 40% to 70% by weight, relative to the total weight of the composition.

Volatile Solvent

A cosmetic composition according to the present invention may comprise one or more volatile solvent(s).

In the context of the present invention, the term "volatile solvent" means a compound that is liquid at room temperature (20° C.) and at atmospheric pressure, having a vapour pressure at 20° C. of greater than 0.1 mmHg, preferably between 0.1 and 300 mmHg and even more preferentially between 0.5 and 200 mmHg.

This volatile solvent may be water, a non-silicone organic solvent, a silicone organic solvent, or mixtures thereof. By way of volatile non-silicone organic solvent, mention may be made of:

$C_1$-$C_4$ volatile alkanols, such as ethanol or isopropanol;

$C_5$-$C_7$ volatile alkanes, such as n-pentane, hexane, cyclopentane, 2,3-dimethylbutane, 2,2-dimethylbutane, 2-methylpentane or 3-methylpentane;

esters of liquid $C_1$-$C_{20}$ acids and of volatile $C_1$-$C_8$ alcohols, such as methyl acetate, n-butyl acetate, ethyl acetate, propyl acetate, isopentyl acetate or ethyl 3-ethoxypropionate;

ketones that are liquid at room temperature and volatile, such as methyl ethyl ketone, methyl isobutyl ketone, diisobutyl ketone, isophorone, cyclohexanone or acetone;

volatile polyols, such as propylene glycol;

volatile ethers, such as dimethoxymethane, diethoxyethane or diethyl ether;

volatile glycol ethers, such as 2-butoxyethanol, butyl diglycol, diethylene glycol monomethyl ether, propylene glycol n-butyl ether or propylene glycol monomethyl ether acetate;

volatile hydrocarbon-based oils such as volatile hydrocarbon-based oils containing from 8 to 16 carbon atoms and mixtures thereof, and especially branched $C_5$-$C_{18}$ alkanes such as $C_5$-$C_{18}$ isoalkanes (also known as isoparaffins), isododecane, isodecane and, for example, the oils sold under the trade name Isopar or Permethyl, and mixtures thereof. Mention may also be made of isohexyl or isodecyl neopentanoate;

volatile $C_4$-$C_{10}$ perfluoroalkanes, such as dodecafluoropentane, tetradecafluorohexane or decafluoropentane;

volatile perfluorocycloalkyls, such as perfluoromethylcyclopentane, 1,3-perfluorodimethylcyclohexane and perfluorodecalin, sold, respectively, under the names Flutec PC10, Flutec PC30 and Flutec PC60 by the company F2 Chemicals, and also perfluorodimethylcyclobutane and perfluoromorpholine;

the volatile fluoroalkyl or heterofluoroalkyl compounds corresponding to the following formula:

$$CH_3—(CH_2)_n—[Z]_t—X—CF_3$$

in which t is 0 or 1; n is 0, 1, 2 or 3; X is a linear or branched divalent perfluoroalkyl radical containing from 2 to 5 carbon atoms, and Z represents O, S or NR, R being a hydrogen, a $—(CH_2)_n—CH_3$ or $—(CF_2)_m—CF_3$ radical, m being equal to 2, 3, 4 or 5.

Among the volatile fluoroalkyl or heterofluoroalkyl compounds, mention may be made especially of methoxynonafluorobutane sold under the name MSX 4518(R), HFE-7100(R) by the company 3M and ethoxynonafluorobutane sold under the name HFE-7200(R) by the company 3M.

Preferably, the solvent is chosen such that its boiling point is less than 200° C.

According to a particular embodiment, the non-silicone organic solvent is chosen from ethanol, isopropanol, acetone and isododecane.

As volatile silicone solvent, mention may be made of low-viscosity silicone compounds chosen from linear or cyclic silicones containing from 2 to 7 silicon atoms, these silicones optionally comprising alkyl or alkoxy groups containing from 1 to 10 carbon atoms, for example octamethylcyclotetrasiloxane, decamethylcyclopentasiloxane, dodecamethylcyclohexasiloxane, heptamethylhexyltrisiloxane, heptamethylethyltrisiloxane, heptamethyloctyltrisiloxane, octamethyltrisiloxane and decamethyltetrasiloxane, and mixtures thereof. According to one particular embodiment, the silicone compound is chosen from cyclopentadimethylsiloxane and dodecamethylcyclohexasiloxane.

According to one particular embodiment, the volatile silicone solvent has a viscosity of less than 50 centistokes.

The volatile silicone is preferably cyclic and chosen from decamethylcyclopentasiloxane, octamethyltrisiloxane and decamethyltetrasiloxane.

By way of example, mention may be made of the decamethylcyclopentasiloxane sold under the name DC-245 by the company Dow Corning, the octamethyltrisiloxane sold under the name DC-200 Fluid 1 cSt by the company Dow Corning, and the decamethyltetrasiloxane sold under the name DC-200 Fluid 1.5 cSt by the company Dow Corning.

This cyclic volatile silicone generally has a low viscosity, for example a viscosity of less than 5 cSt at 25° C.

Preferably, the volatile silicone is cyclic and is decamethylcyclopentasiloxane sold under the name DC-245 by the company Dow Corning.

Preferably, the cosmetic composition comprises less than 20% of volatile solvent(s), preferably less than 10% of volatile solvent(s), and even more preferentially the cosmetic composition is free of volatile solvent(s).

In this first embodiment variant, the composition solidifies when its temperature drops back down to a value less than or equal to its melting point.

B. Fluid Composition Containing Particles in the Dispersed State

According to a second embodiment variant of the composition, the composition is fluid at room temperature and contains at least particles in the dispersed state in a liquid medium, said composition being solidifiable via the aggregation of said particles.

For the purposes of the invention, the term "fluid" is intended to characterize the fact that a composition according to the invention is not solid. In other words, it manifests fluidity sufficient to have flow properties.

According to this embodiment variant, a composition according to the invention may advantageously have a viscosity of less than 100 Pa·s, preferably between 0.01 Pa·s and 50 Pa·s, preferably between 0.1 Pa·s and 50 Pa·s and more preferentially between 5 Pa·s and 50 Pa·s, at room temperature and ambient pressure, the viscosity being in particular measured using a Rheomat RM100® machine.

In the context of the present invention, it is the reorganization of the particles dispersed in the liquid medium which produces the setting of the particles to a solid.

To do this, a composition may comprise from 10% to 55% by weight and preferably from 12% to 50% by weight of particles in the dispersed state, relative to the total weight of the composition.

These particles in the solid state are present, in the composition according to the invention, in a state dispersed in the associated liquid medium. Thus, a composition according to the invention may be in the form of a colloid or a suspension.

As previously mentioned, the cosmetic composition is solidifiable via the aggregation of the particles in the dispersed state.

The particles aggregate under the effect of a temperature increase and/or evaporation of the liquid medium. Thus, the composition passes from a fluid state to a thicker state, and better still to a solid state.

For the purposes of the invention, the term "aggregation" means that a sufficiently cohesive material or deposit is obtained, and that said material or deposit may be isolated.

A macroscopically continuous and preferably cohesive deposit is thus obtained. Preferably, an isolatable deposit that can be individually manipulated is obtained. For example, such a deposit may be obtained when the deposit is produced by casting on a non-stick surface, such as a PTFE-coated or silicone-coated surface.

Consequently, the present invention is different from a composition which solidifies by aggregation but which does not become cohesive. For example, a composition according to the invention is different from a composition containing water and pigments which aggregate on drying. Specifically, the deposit obtained will then be pulverulent but not cohesive.

Thus, according to a preferred embodiment, a fluid cosmetic composition according to the invention affords, after its solidification via aggregation of the particles, a cohesive material or deposit, which is preferably water-resistant. In particular, such a cohesive material or deposit has a water uptake of less than or equal to 10%, preferably less than or equal to 5% and even more preferentially less than or equal to 3%.

For the purposes of the invention, the term "water uptake" means the percentage of water absorbed by the material or deposit after 60 minutes of immersion in water at 25° C. (room temperature).

The water uptake is measured for a layer of composition 300 μm thick (before drying), deposited using a 300 t applicator onto a glass plate equipped with a layer of Teflon tape and then dried for 24 hours at 30° C. on a thermostatically maintained plate. Three pieces of about 1 $cm^2$ are cut out of the dry film and then weighed (mass measurement M1), then immersed in the water for 60 minutes; after immersion, the piece of film is wiped to remove the excess surface water and then weighed again (mass measurement M2). The difference M2−M1 corresponds to the amount of water absorbed by the film. The water uptake is equal to $[(M2-M1)/M1]\times100$ and is expressed as a weight percentage of water relative to the weight of the film.

Thus, according to one embodiment, the aggregation of the particles dispersed in the liquid medium can be induced by at least partial, or even total, evaporation of said liquid medium.

Preferably, according to this embodiment, the evaporation of said liquid medium is performed at a temperature of between 45° C. and 90° C., preferably between 50° C. and 80° C.

The evaporation of the liquid medium may also be performed at room temperature, by being in particular stimulated by forced ventilation, for example using a hairdryer.

Thus, such a composition according to the invention lends itself to thickening via the partial or total evaporation of the liquid ingredients, most commonly represented predominantly by water.

As mentioned previously, a composition according to the invention, subject to this phenomenon of evaporation of the liquid ingredients forming its liquid medium, has the advantage of solidifying to form, in the end, a totally cohesive solid material.

This phenomenon is to be distinguished from a phase transition in the true sense, during the passing from one state of the material to another, such as crystallization.

As previously seen, the cosmetic composition comprises particles in the dispersed state and a liquid medium.

Said liquid medium may be chosen, for example, from water, ethanol or mixtures thereof.

The particles in the dispersed state may be chosen from a wax, a film-forming polymer, and mixtures thereof, and in particular may be chosen from a mixture of a film-forming polymer and a wax.

In particular, it may be a question of wax emulsions, a microdispersion of wax in water, a dispersion of wax in an anhydrous solvent or else a film-forming polymer dispersed in water.

Preferably, the cosmetic composition comprises one or more film-forming polymers in the form of particles in the dispersed state and a liquid medium.

Wax

It may in particular be a wax as defined above.

According to one embodiment of the invention, a composition according to the invention advantageously comprises from 0% to 35% by weight, in particular from 5% to 30% by weight of wax(es), or even from 10% to 25% by weight of wax(es), relative to the total weight of the composition.

In another embodiment, a composition according to the invention comprises an amount of wax of less than 8%, or even less than 3%, and even better still less than 1% by weight, relative to the total weight of the composition.

In the context of the present invention, mention may be made, by way of particularly advantageous wax, of camauba wax, advantageously in the form of a microdispersion, for example the one sold under the name Mexoryl SAP by the company Chimex.

Film-Forming Polymer

A composition according to the invention may preferably comprise at least an aqueous dispersion of film-forming polymer particles and optionally at least one additional film-forming polymer (not present in the form of an aqueous dispersion of particles, such as a water-soluble film-forming polymer).

In the present patent application, the term "film-forming polymer" means a polymer that is capable, by itself or in the presence of an auxiliary film-forming agent, of forming a macroscopically continuous deposit, and preferably a cohesive deposit, and even better still a deposit whose cohesion and mechanical properties are such that said deposit can be isolated and manipulated individually, for example when said deposit is prepared by pouring onto a non-stick surface such as a Teflon-coated or silicone-coated surface.

A composition according to the invention preferably comprises a total solids content of film-forming polymer(s) of greater than or equal to 5% by weight, preferably greater than or equal to 10% by weight and better still greater than or equal to 12% by weight, relative to the total weight of the composition.

A composition according to the invention preferably comprises a total solids content of film-forming polymer(s) ranging from 10% to 55% by weight, in particular from 12% to 50% by weight, relative to the total weight of the composition.

In particular, a composition according to the invention preferably comprises at least an aqueous dispersion of particles formed from one or more film-forming polymers.

It may also comprise at least one water-soluble film-forming polymer.

Thus, a composition according to the invention may comprise at least one additional film-forming polymer, different from the film-forming polymer particles present in aqueous dispersion form.

The content of this (these) "water-soluble" additional film-forming polymer(s) is preferably less than or equal to 10% by weight, even more preferentially less than or equal to 5% by weight and better still less than or equal to 2% by weight, relative to the total weight of the composition.

Film-Forming Polymer(s) in Aqueous Dispersion

Such a film-forming polymer present in said preparation of the composition in the form of particles in aqueous dispersion is generally known as a (pseudo)latex, i.e. a latex or psuedolatex. Techniques for preparing these dispersions are well known to those skilled in the art.

A dispersion that is suitable for use in the invention may comprise one or more types of particle, these particles possibly varying as regards their size, their structure and/or their chemical nature.

A composition according to the invention may comprise a total solids content of film-forming polymer particles in aqueous dispersion form of greater than or equal to 10% by weight, relative to the total weight of the composition.

Advantageously, a composition according to the invention comprises a total solids content of film-forming polymer particles in aqueous dispersion form of greater than or equal to 12% by weight, relative to the total weight of the composition.

A composition according to the invention preferably comprises a total solids content of film-forming polymer particles ranging from 10% to 55% by weight, better still from 12% to 50% by weight, relative to the total weight of the composition.

The total content of film-forming polymer particles present in aqueous dispersion form is preferably greater than or equal to 30% by weight and preferentially greater than or equal to 40% by weight, relative to the total weight of the particles.

These particles may be of anionic, cationic or neutral nature and may constitute a mixture of particles of different natures.

Among the film-forming polymers that may be used in the composition of the present invention, mention may be made of synthetic polymers, of free-radical type or of polycondensate type, and polymers of natural origin, and mixtures thereof. In general, these polymers may be random polymers, block copolymers of A-B type, multiblock copolymers A-B-A or else of ABCD type, etc., or even grafted polymers.

Free-Radical Film-Forming Polymer:

The term "free-radical polymer" means a polymer obtained by polymerization of unsaturated and especially ethylenic monomers, each monomer being capable of homopolymerizing (unlike polycondensates).

The film-forming polymers of free-radical type may in particular be acrylic and/or vinyl homopolymers or copolymers.

The vinyl film-forming polymers may result from the polymerization of ethylenically unsaturated monomers containing at least one acid group and/or esters of these acid monomers and/or amides of these acid monomers.

Ethylenically unsaturated monomers containing at least one acid group or monomer bearing an acid group that may be used include $\alpha,\beta$-ethylenic unsaturated carboxylic acids such as acrylic acid, methacrylic acid, crotonic acid, maleic acid or itaconic acid. (Meth)acrylic acid and crotonic acid are used in particular, and more particularly (meth)acrylic acid.

The esters of acid monomers are advantageously chosen from (meth)acrylic acid esters (also known as (meth)acrylates), in particular (meth)acrylates of an alkyl, in particular of a $C_1$-$C_{20}$ and more particularly $C_1$-$C_8$ alkyl, (meth) acrylates of an aryl, in particular of a $C_6$-$C_{10}$ aryl, and (meth)acrylates of a hydroxyalkyl, in particular of a $C_2$-$C_6$ hydroxyalkyl.

Among the alkyl (meth)acrylates that may be mentioned are methyl methacrylate, ethyl methacrylate, butyl methacrylate, isobutyl methacrylate, 2-ethylhexyl methacrylate and lauryl methacrylate.

Mention may be made, among hydroxyalkyl (meth)acrylates, of hydroxyethyl acrylate, 2-hydroxypropyl acrylate, hydroxyethyl methacrylate or 2-hydroxypropyl methacrylate.

Mention may be made, among aryl (meth)acrylates, of benzyl acrylate and phenyl acrylate.

The (meth)acrylic acid esters are in particular alkyl (meth) acrylates.

According to the present invention, the alkyl group of the esters can be either fluorinated or perfluorinated, that is to say that a portion or all of the hydrogen atoms of the alkyl group are replaced by fluorine atoms.

Mention may be made, as amides of the acid monomers, for example, of (meth)acrylamides and in particular N-alkyl (meth)acrylamides, in particular N—($C_2$-$C_{12}$ alkyl)(meth) acrylamides. Among the N-alkyl(meth)acrylamides that may be mentioned are N-ethylacrylamide, N-t-butylacrylamide and N-t-octylacrylamide.

The vinyl film-forming polymers may also result from the homopolymerization or copolymerization of monomers chosen from vinyl esters and styrene monomers. In particular, these monomers may be polymerized with acid monomers and/or esters thereof and/or amides thereof, such as those mentioned above.

Examples of vinyl esters that may be mentioned are vinyl acetate, vinyl neodecanoate, vinyl pivalate, vinyl benzoate and vinyl t-butylbenzoate.

Styrene monomers that may be mentioned include styrene and α-methylstyrene.

The list of monomers given is not limiting, and it is possible to use any monomer known to those skilled in the art included in the categories of acrylic and vinyl monomers (including monomers modified with a silicone chain).

Vinyl polymers that may also be used include silicone acrylic polymers.

Mention may also be made of polymers resulting from free-radical polymerization of one or more free-radical monomers inside and/or partially at the surface of preexisting particles of at least one polymer chosen from the group consisting of polyurethanes, polyureas, polyesters, polyesteramides and/or alkyds. These polymers are generally referred to as "hybrid polymers".

Polycondensate:

As film-forming polymer of polycondensate type, mention may be made of anionic, cationic, nonionic or amphoteric polyurethanes, acrylic polyurethanes, polyvinylpyrrolidone-polyurethanes, polyester-polyurethanes, polyether-polyurethanes, polyureas, polyurea/polyurethanes and silicone polyurethanes, and mixtures thereof.

The film-forming polyurethane may be, for example, an aliphatic, cycloaliphatic or aromatic polyurethane, polyurea/urethane or polyurea copolymer comprising, alone or as a mixture, at least one block chosen from:

- a block of aliphatic and/or cycloaliphatic and/or aromatic polyester origin, and/or
- a branched or unbranched silicone block, for example polydimethylsiloxane or polymethylphenylsiloxane, and/or
- a block comprising fluoro groups.

The film-forming polyurethanes as defined in the invention may also be obtained from branched or unbranched polyesters or from alkyds comprising labile hydrogens, which are modified by reaction with a diisocyanate and a difunctional organic compound (for example dihydro, diamino or hydroxyamino), also comprising either a carboxylic acid or carboxylate group, or a sulfonic acid or sulfonate group, or alternatively a neutralizable tertiary amine group or a quaternary ammonium group.

Among the film-forming polycondensates, mention may also be made of polyesters, polyesteramides, fatty-chain polyesters, polyamides and epoxyester resins.

The polyesters may be obtained, in a known manner, by polycondensation of dicarboxylic acids with polyols, especially diols.

The dicarboxylic acid may be aliphatic, alicyclic or aromatic. Examples of such acids that may be mentioned include: oxalic acid, malonic acid, dimethylmalonic acid, succinic acid, glutaric acid, adipic acid, pimelic acid, 2,2-dimethylglutaric acid, azelaic acid, suberic acid, sebacic acid, fumaric acid, maleic acid, itaconic acid, phthalic acid, dodecanedioic acid, 1,3-cyclohexanedicarboxylic acid, 1,4-cyclohexanedicarboxylic acid, isophthalic acid, terephthalic acid, 2,5-norboranedicarboxylic acid, diglycolic acid, thiodipropionic acid, 2,5-naphthalenedicarboxylic acid and 2,6-naphthalenedicarboxylic acid. These dicarboxylic acid monomers may be used alone or as a combination of at least two dicarboxylic acid monomers. Among these monomers, the ones chosen in particular are phthalic acid, isophthalic acid and terephthalic acid.

The diol may be chosen from aliphatic, alicyclic and aromatic diols. The diol used is chosen in particular from: ethylene glycol, diethylene glycol, triethylene glycol, 1,3-propanediol, cyclohexanedimethanol and 4-butanediol. Other polyols that may be used are glycerol, pentaerythritol, sorbitol and trimethylolpropane.

The polyesteramides may be obtained in a manner analogous to that of the polyesters, by polycondensation of diacids with diamines or amino alcohols. Diamines that may be used are ethylenediamine, hexamethylenediamine and meta- or para-phenylenediamine. An amino alcohol that may be used is monoethanolamine.

Polymer of Natural Origin:

Use may be made in the present invention of optionally modified polymers of natural origin, such as shellac resin, sandarac gum, dammar resins, elemi gums, copal resins, water-insoluble cellulose-based polymers such as nitrocellulose, modified cellulose esters especially including carboxyalkyl cellulose esters such as those described in patent application US 2003/185 774, and mixtures thereof.

According to a particular embodiment of the invention, said at least one film-forming polymer in the dispersed state is chosen from acrylic polymer dispersions, polyurethane dispersions, sulfopolyester dispersions, vinyl dispersions, polyvinyl acetate dispersions, vinylpyrrolidone, dimethylaminopropylmethacrylamide and lauryldimethylpropylmethacrylamidoammonium chloride terpolymer dispersions, dispersions of polyurethane/polyacrylic hybrid polymers and dispersions of particles of core-shell type, and mixtures thereof.

Various types of aqueous dispersions, in particular commercial aqueous dispersions, which are suited to the preparation of the composition in accordance with the present invention are detailed below.

1/ Thus, according to a preferred embodiment of the invention, the aqueous dispersion of polymer particles is an aqueous dispersion of acrylic polymer.

The acrylic polymer can be a styrene/acrylate copolymer and especially a polymer chosen from copolymers resulting from the polymerization of at least one styrene monomer and at least one $C_1$-$C_{18}$ alkyl (meth)acrylate monomer.

As styrene monomers that may be used in the invention, examples that may be mentioned include styrene and α-methylstyrene, and in particular styrene.

The $C_1$-$C_{18}$ alkyl (meth)acrylate monomer is in particular a $C_1$-$C_{12}$ alkyl (meth)acrylate and more particularly a $C_1$-$C_{10}$ alkyl (meth)acrylate. The $C_1$-$C_{18}$ alkyl (meth)acrylate monomer may be chosen from methyl acrylate, methyl methacrylate, ethyl acrylate, propyl acrylate, butyl acrylate, butyl methacrylate, hexyl acrylate, octyl acrylate, 2-ethylhexyl acrylate, lauryl (meth)acrylate and stearyl (meth) acrylate.

As acrylic polymer in aqueous dispersion, use may be made according to the invention of the styrene/acrylate copolymer sold under the name Joncryl SCX-8211® by the company BASF or Syntran 5760cg by the company Interpolymer, the acrylic polymer sold under the reference Acronal® DS—6250 by the company BASF, the acrylic copolymer Joncryl® 95 by the company BASF.

2/ According to one embodiment of the invention, the aqueous dispersion of polymer particles is an aqueous dispersion of polyester-polyurethane and/or polyether-polyurethane particles, in particular in anionic form.

The anionic nature of the polyester-polyurethanes and of the polyether-polyurethanes used according to the invention is due to the presence in their constituent units of groups bearing a carboxylic acid or sulfonic acid function.

The polyester-polyurethane or polyether-polyurethane particles used according to the invention are generally sold in aqueous dispersion form.

The particle content of said dispersions currently available on the market ranges from about 20% to about 60% by weight relative to the total weight of the dispersion.

Among the anionic polyester-polyurethane dispersions that may be used in the compositions according to the invention, mention may be made in particular of the product sold under the name Avalure UR 405® by the company Noveon or Baycusan C1004 by the company Bayer Material Science.

Among the anionic polyether-polyurethane particle dispersions that may be used according to the invention, mention may be made in particular of the products sold under the name Avalure UR 450® by the company Noveon and under the name Neorez R 970® by the company DSM.

According to a particular embodiment of the invention, use may be made of a mixture of commercial dispersions consisting of anionic polyester-polyurethane particles as defined above and of anionic polyether-polyurethane particles also defined above.

For example, use may be made of a mixture consisting of the dispersion sold under the name Sancure 861® or a mixture of the product sold under the name Avalure UR 405® and of the product sold under the name Avalure UR 450®, these dispersions being sold by the company Noveon.

3/ According to another particular embodiment of the invention, the aqueous dispersion used comprises a mixture of at least two film-forming polymers in the form of particles that differ by their respective glass transition temperatures ($T_g$).

In particular, according to one embodiment of the invention, the composition in accordance with the invention may comprise at least one first film-forming polymer in the dispersed state and at least one second film-forming polymer in the dispersed state, said first and second polymers having different $T_g$ values and, preferably, the $T_g$ of the first polymer ($T_{g1}$) is higher than the $T_g$ of the second polymer ($T_{g2}$). In particular, the difference between the $T_{g1}$ and $T_{g2}$ values is, as an absolute value, at least 10° C. and preferably at least 20° C.

More precisely, it comprises in an acceptable aqueous medium:

a) particles dispersed in the aqueous medium of a first film-forming polymer having at least one glass transition temperature $T_{g1}$ greater than or equal to 20° C., and b) particles dispersed in the aqueous medium of a second film-forming polymer having at least one glass transition temperature $T_{g2}$ less than or equal to 70° C.

This dispersion generally results from a mixing of two aqueous dispersions of film-forming polymer.

The first film-forming polymer has at least one glass transition temperature $T_{g1}$ greater than or equal to 20° C., in particular ranging from 20° C. to 150° C. and advantageously greater than or equal to 40° C., especially ranging from 40° C. to 150° C. and in particular greater than or equal to 50° C., especially ranging from 50° C. to 150° C.

The second film-forming polymer has at least one glass transition temperature $T_{g2}$ less than or equal to 70° C., especially ranging from −120° C. to 70° C. and in particular less than 50° C., especially ranging from −60° C. to +50° C. and more particularly ranging from −30° C. to 30° C.

Measurement of the glass transition temperature ($T_g$) of a polymer is performed by DMTA (dynamic and mechanical temperature analysis) as described below.

To measure the glass transition temperature ($T_g$) of a polymer, viscoelasticity tests are performed with a "Polymer Laboratories" DMTA machine, on a sample of film. This film is prepared by pouring the aqueous dispersion of film-forming polymer in a Teflon-coated matrix followed by drying at 120° C. for 24 hours. A film is then obtained, from which specimens are cut out (for example using a punch). These specimens are typically about 150 μm thick, from 5 to 10 mm wide and have a useful length of about 10 to 15 mm. A tensile stress is imposed on this sample. The sample undergoes a static force of 0.01 N on which is superimposed a sinusoidal displacement of ±8 μm at a frequency of 1 Hz. The test is thus performed in the linear range, at low levels of deformation. This tensile stress is performed on the sample at temperatures ranging from −150° C. to +200° C., with a temperature variation of 3° C. per minute.

The complex modulus $E^*=E'+iE''$ of the polymer tested is thus measured as a function of the temperature.

From these measurements, the dynamic moduli E' and E" and the damping power: $t_{g\delta}=E''/E'$ are deduced.

The curve of the $t_{g\delta}$ values is then plotted as a function of the temperature; this curve presents at least one peak. The glass transition temperature $T_g$ of the polymer corresponds to the temperature at the top of this peak.

When the curve presents at least two peaks (in this case, the polymer presents at least two $T_g$ values), the value taken as the $T_g$ of the polymer tested is the temperature for which the curve presents a peak of the largest amplitude (i.e.

corresponding to the largest $t_{g\delta}$ value; in this case, only the "major" $T_g$ is considered as the $T_g$ value of the polymer tested).

In the present invention, the transition temperature $T_{g1}$ corresponds to the "major" $T_g$ (in the predefined sense) of the first film-forming polymer when the latter presents at least two $T_g$ values; the glass transition temperature $T_{g2}$ corresponds to the "major" $T_g$ of the second film-forming polymer when the latter presents at least two $T_g$ values.

The first film-forming polymer and the second film-forming polymer may be chosen, independently of each other, from free-radical polymers, polycondensates and polymers of natural origin as defined previously having the glass transition temperature characteristics defined previously.

As first film-forming polymer in aqueous dispersion, use may be made of the aqueous polymer dispersions sold under the names Neorez R-989® by the company DSM, Joncryl 95 and Joncryl® 8211 by the company BASF.

As second film-forming polymer in aqueous dispersion, use may be made, for example, of the aqueous polymer dispersions sold under the names Avalure® UR-405, Avalure® UR-460 by the company Noveon or Acrilem IC89RT® by the company ICAP, and Neocryl A-45 by the company DSM.

The film-forming polymer of the aqueous dispersion Avalure® UR-460 is a polyurethane obtained by polycondensation of polytetramethylene oxide, tetramethylxylylene diisocyanate, isophorone diisocyanate and dimethylolpropionic acid.

According to a most particularly preferred embodiment of the invention, use is made, as first and second film-forming polymers in aqueous dispersion, of the combination of styrene/acrylate polymer dispersion such as the dispersion sold under the reference Joncryl 8211® by BASF and of acrylic polymer dispersion such as the dispersion sold under the reference Neocryl A-45® by DSM.

According to another preferred embodiment, use is made, as first film-forming polymer in aqueous dispersion, of an acrylic polymer dispersion such as the dispersion sold under the reference Joncryl 95® by BASF and, as second film-forming polymer, of a dispersion of anionic polyurethane polymer sold under the reference Avalure UR405® by DSM.

As aqueous dispersions of film-forming polymer, use may be made of:

the acrylic dispersions sold under the names Acronal DS-6250® by the company BASF, Neocryl A-45®, Neocryl XK-90®, Neocryl A-1070®, Neocryl A-1090®, Neocryl BT-62®, Neocryl A-1079® and Neocryl A-523® by the company DSM, Joncryl 95® and Joncryl 8211® by the company BASF, Daitosol 5000 AD® or Daitosol 5000 SJ by the company Daito Kasey Kogyo; Syntran 5760 CG by the company Interpolymer, the aqueous polyurethane dispersions sold under the names Neorez R-981® and Neorez R-974® by the company DSM, Avalure UR-405®, Avalure UR-410®, Avalure UR-425®, Avalure UR-450®, Sancure 875®, Avalure UR 445® and Avalure UR 450® by the company Noveon, Impranil 85® by the company Bayer, and Baycusan C1004® by the company Bayer Material Science, the sulfopolyesters sold under the brand name Eastman AQ® by the company Eastman Chemical Products, vinyl dispersions such as Mexomere PAM, aqueous dispersions of polyvinyl acetate such as Vinybran® from the company Nisshin Chemical or the products sold by the company Union Carbide, aqueous dispersions of vinylpyrrolidone, dimethylaminopropylmethacrylamide and lauryldimethylpropylmethacrylamidoammonium chloride terpolymer such as Styleze W® from ISP, aqueous dispersions of polyurethane/polyacrylic hybrid polymer such as the products sold under the references Hybridur® by the company Air Products or Duromer® from National Starch, dispersions of particles of core-shell type such as the products sold by the company Arkema under the reference Kynar® (core: fluorinated—shell: acrylic) or alternatively those described in U.S. Pat. No. 5,188,899 (core: silica—shell: silicone) and mixtures thereof.

According to a preferred embodiment, a composition in accordance with the invention comprises an aqueous dispersion of particles chosen from aqueous dispersions of acrylic film-forming polymer(s) and derivatives, in particular of styrene-acrylic film-forming polymer(s) and derivatives, and aqueous dispersions of polyurethane polymer(s), in particular of polyester-polyurethane polymer(s), and derivatives thereof, and a mixture or mixtures thereof.

In the context of the present invention, as particularly advantageous film-forming polymer, mention may be made of latexes, for example the product sold under the name Syntran 5760 CG by the company Interpolymer.

According to one particular embodiment, the total content of wax(es) and the total content of film-forming polymer particles are such that the weight ratio of the wax(es) to the film-forming polymer particles is greater than or equal to 1/2 and better still 2/3.

Preferably, this ratio is inclusively between 1/2 and 2 and even more preferentially between 2/3 and 3/2.

According to one particular embodiment, the total content of wax(es) and the total content of film-forming polymer particles, which are both preferentially present in the form of particles in aqueous dispersion, with the film-forming polymer(s) chosen from aqueous dispersions of acrylic film-forming polymer(s) and derivatives, in particular styrene-acrylic and derivatives, and aqueous dispersions of polyester-polyurethane hybrid polymer(s), and mixtures thereof, are such that the weight ratio of the wax particles to said film-forming polymer particles is greater than or equal to 1/2 and better still 2/3.

For example, this ratio is inclusively between 1/2 and 2 and even more preferentially between 2/3 and 3/2.

Preferably, the particles in the dispersed state may be chosen from a wax, latex, and mixtures thereof.

According to a particular embodiment, a composition according to the invention consists of a particulate dispersion comprising at least one mixture of a microdispersion of carnauba and a latex.

The composition may be packaged in a pressurized container and may comprise a pressurized propellant gas.

During the moulding, the composition may be heated above the vaporization temperature of the liquid medium.

The composition may be ventilated, for example by a stream of air, during the moulding, so as to accelerate the evaporation of the liquid medium.

The opening of the jaws may also contribute to the evaporation of the liquid medium.

A specific absorber of the liquid medium may be introduced during the moulding or prior thereto. The solvent is then at least partly eliminated by absorption.

The mould, in particular if it is disposable, may comprise an absorber specific to the liquid medium.

The device may comprise a system which aids the drying of the composition, the system providing energy, in particular in the form of light or heat, and/or comprising an aeration circuit, suction and/or blowing of air.

One or both of the jaws may have a system for admitting drying compounds, such as a calcium salt for example.

The mould may comprise an absorbent material or be covered with absorbent or desiccating material, in particular a ceramic or a porous material, or a chemical active agent which is capable of absorbing, such as a silica gel or at least one compound such as an aerogel, clay, bentonite, calcium or cobalt or copper salts (chlorate, sulfate), lithium halides, potassium carbonate, magnesium sulfate or sodium sulfate, or organic compounds such as sugars.

The keratin fibres to be treated may be covered with an absorbent material as described above, before they are introduced into the mould.

C. Fluid Composition Comprising an Activatable Compound

According to a third embodiment variant of the composition that is suitable especially for the first, second and third aspects thereof, a cosmetic composition in a process or an assembly according to the invention is fluid at room temperature and contains at least one compound that is activatable by a physical or chemical stimulus, said composition being solidifiable via the conversion of the activated form of said compound into a solid material, by self-reaction and/or interaction with at least one supplementary compound.

For the purposes of the invention, the term "fluid" is intended to characterize the fact that a composition according to the invention is not solid. In other words, it manifests fluidity sufficient to have flow properties.

Thus, such a composition may advantageously have a viscosity of less than 100 Pa·s, preferably between 0.1 Pa·s and 50 Pa·s, preferably between 1 Pa·s and 50 Pa·s, at room temperature and ambient pressure, the viscosity being measured in particular using a Rheomat RM100® machine.

A composition according to this embodiment variant lends itself to solidification via the conversion of the activated form of an activatable compound into a solid material, by self-reaction and/or interaction with at least one supplementary compound.

The crosslinking carried out may be of the AA or AB type.

Thus, the composition is fluid before reaction and becomes solid after reaction.

For the purposes of the invention, an "activatable" compound is a compound or a species which reacts characteristically in response to a physical or chemical stimulus.

In particular, the physical or chemical stimulus may be a variation in light, for example UV or visible light, in pH, in temperature or in moisture content, or else the bringing into contact with at least one reagent which may or may not be different from the supplementary compound.

Thus, in response to such a stimulus, the activated form of the activatable compound is converted into a solid material, then inducing the solidification of the composition containing it.

According to a first embodiment, the composition is solidifiable by self-reaction of the activatable compound.

In this embodiment, the activatable compound reacts with itself or on itself in response to a physical or chemical stimulus.

More particularly, the activatable compound is a photosensitive compound.

Thus, the stimulus may be a variation in light, for example UV or visible light. Such a stimulus may generate crosslinking of the activatable compound.

Thus, the activatable compound is preferably chosen from monomers, oligomers or polymers comprising an acrylate, methacrylate, acrylamide or methacrylamide function and monomers, oligomers or polymers capable of reacting by 2+2 or 2+4 cycloaddition, such as stilbazolium compounds.

These may advantageously be methacrylate compounds sold under the name Power Polish™ Top Coat by the company CND Shellac.

As oligomers or polymers capable of reacting by 2+2 or 2+4 cycloaddition, mention may in particular be made of polyvinyl alcohol/acetates grafted with stilbazolium functions.

According to a second embodiment, the composition is solidifiable by interaction of the activatable compound with at least one supplementary compound, the interaction being of covalent or non-covalent type.

In this embodiment, the two activatable and supplementary compounds may react rapidly, and produce, in less than a few minutes, via their conversion, the desired solidification of the composition containing them.

According to a first aspect, the supplementary compound is a compound present in the atmosphere, for example water or oxygen, and the activatable compound is chosen from a siccative oil, a monomer, oligomer or polymer comprising a silane function, a cyanoacrylate, a reactive silicone, and mixtures thereof.

The term "siccative oil" is intended to denote an oil which, when spread as a thin coat and then exposed to the air, transforms into a solid film coating. In particular, the term "siccative oil" is intended to denote, in the context of the present invention, oils, and preferably triglycerides, comprising conjugated double bonds, preferably comprising at least two conjugated double bonds and preferably comprising at least three conjugated double bonds.

The siccative oils in accordance with the invention may be of natural origin. Advantageously, the siccative oil may be chosen from siccative vegetable oils such as linseed oil, Chinese (or Cantonese) wood oil, oiticica oil, vemonia oil, poppy oil, pomegranate oil or marigold oil, esters of these vegetable oils, alkyd resins obtained from these vegetable oils, and mixtures thereof. Alkyd resins are polyesters comprising hydrocarbon-based chains of fatty acids, obtained in particular by the polymerization of polyols and polyacids or the corresponding anhydride thereof, in the presence of fatty acids. These fatty acids are present, in particular in triglyceride form, in the majority of natural oils, such as, in particular, the abovementioned oils.

The siccative oil that is suitable for use in the present invention may be modified by chemical reaction. In particular, it may be refined and/or partially polymerized. In this respect, mention may be made of blown oils and stand oils, and maleinized, epoxidized or boiled oils. The blowing of an oil is characterized in particular by polymerization of said oil with atmospheric oxygen.

As cyanoacrylate that is quite particularly suitable for use in the invention, mention may be made of 2-octyl 2-cyanoacrylate stabilized with 1% phosphoric acid, for example Rite Lok CON895, sold by the company Chemence.

Advantageously, the activatable compound is ethyl cyanoacrylate, in particular the product sold under the name Superglue 3 by the company Loctite which may also be mentioned.

The reactive silicones may be chosen from moisture-sensitive reactive silicones.

Preferably, they will be the reactive silicones sold under the name Joint & Fix by the company GEB.

According to a second aspect, the activatable compound and the supplementary compound have, respectively, complementary functional groups.

The term "complementary functional groups" is intended to mean groups which are capable of reacting with one another.

Thus, the activatable compound and the supplementary compound may be, respectively, a nucleophilic compound and an electrophilic compound.

As pairs of nucleophilic compound and electrophilic compound that are most particularly suitable for use in the invention, mention may be made especially of polyols or polyamines to be reacted with polyanhydrides or polyisocyanates.

Preferably, the nucleophilic compound and the electrophilic compound are a polyamine and a polyanhydride or two distinct reactive silicones.

As reactive silicones, mention may be made most particularly of the Platsil gel 10 (A:B) reactive silicones sold by the company Polytek or the product Dow Corning 7-FC4210 Elastomer Film-Forming Base sold by the company Dow Corning and the product Dow Corning 7-FC4210 Curing Agent sold by the company Dow Corning.

As example of polyamine/polyanhydride, use may also be made of diaminopropane to be mixed with Gantrez AN-119 BF from the company Ashland.

The activatable compound and the supplementary compound may also be, respectively, a cationic polymer and an anionic polymer.

As pairs of cationic polymer and anionic polymer that are most particularly suitable for use in the invention, mention may be made especially of polyacrylates or polymethacrylates or a copolymer (such as UltraHold Strong from the company BASF) bearing neutralized acid functions (aqueous ammonia, amine, strong base) to be combined with cationic polymers such as JR 400, quaternized polysaccharides (quaternized guar gum of the Jaguar C13S type from the company Rhodia, quaternized HEC), polyDADMAC such as Polyquaternium-7 from the company Nalco.

The activatable compound and the supplementary compound may also be, respectively, a carbonate or alginate compound and a calcium-based compound.

As carbonate compound, mention may be made especially of sodium, potassium or ammonium carbonate or bicarbonate.

The alginate compounds may be chosen from Protanal PH 6160 from the company FMC Corporation.

By way of calcium-based compounds, mention may be made of calcium chloride and other halides.

Preferably, this involves a solution of sodium alginate such as the product sold under the name Kelcosol by the company ISP and an aqueous solution of calcium chloride.

Catalyst

According to a preferred embodiment, the composition also comprises a catalyst, which is especially suitable for accelerating the reaction.

By way of example in the case of the reactive silicones, the catalyst may be chosen especially from titanium derivatives.

The reactivity of the compound or of the composition may be accelerated by conventional routes, such as providing energy, especially by light or heat, or a catalyst.

The moulding device may comprise a system for admitting at least one reagent. One or both of the jaws may comprise at least two separate systems for admitting reagents, the reagents coming into contact within the mould cavity or cavities.

The device may comprise a chamber for mixing the reagents upstream of the mould cavity or cavities.

The device may comprise a triggering system, such as an illuminator, especially an IR-, UV- or visible-light illuminator. The mould is then preferably transparent to the wavelengths used to trigger the reaction.

D. Ductile Composition

According to a fourth embodiment variant of the composition that is suitable especially for the first and second aspects thereof and also the third aspect, the cosmetic composition is ductile and preferably has a Young's modulus of less than or equal to 100 MPa, at room temperature and ambient pressure.

In this embodiment variant of the composition, said composition is combined with a mould that is deformable under compression or suction.

The term "ductile" means the capacity of the cosmetic composition to deform plastically without breaking. Breaking occurs when a defect, such as a crack or a cavity, induced by the plastic deformation, becomes critical and propagates. The ductility therefore reflects the ability of the cosmetic composition to resist this propagation.

Thus, the composition under consideration deforms, under compression or under suction, plastically, i.e. it retains at least partly the deformation that it is given by the mould, without breaking.

In particular, the composition, under compression or under suction, deforms and hugs the shape of the keratin fibre(s) introduced into the cavity or cavities of the deformable mould.

Preferably, the cosmetic composition is deformable at a pressure of between 0.02 bar and 100 bar, at room temperature.

In addition, the composition is preferably self-healing, i.e. it gives a material which, when it is subjected to a mechanical deformation causing it to produce a crack, said crack heals and, in so doing, the material regains all or part of its integrity. The healing operation takes place by itself within a period ranging from a few seconds to one hour approximately, by simple contact of the two edges of the crack.

In particular, the composition is preferably pasty, i.e. the consistency of this composition is intermediate between a solid phase and a liquid phase. The viscosity of a pasty composition is advantageously greater than 0.1 Pa·s and preferably greater than 1 Pa·s, at 25° C. with a shear rate of 10 $s^{-1}$, the viscosity being measured in particular using a Rheomat RM100® machine.

Thus, the composition under consideration is sufficiently pasty so as not to creep under its own weight under the room temperature and ambient pressure conditions. In this case, the composition may advantageously be in a form that aids the integration of the keratin fibres. For example, striations may be made in the composition. The striations guide the keratin fibres and facilitate the integration within the material.

Preferably, the cosmetic composition has a Young's modulus of less than or equal to 100 MPa at room temperature and ambient pressure.

In particular, it may have a Young's modulus of less than or equal to 10 MPa at room temperature and ambient pressure.

The Young's modulus characterizes the strength of the composition exposed to a mechanical action. Thus, it characterizes the force to be applied, per unit of surface area, in order to produce a modification of the composition.

Tensile tests are performed to measure the Young's modulus. The film is cut into specimens of rectangular shape, 80 mm long and 15 mm wide.

The tests are performed on a machine sold under the name Lloyd or sold under the name Zwick, under the same temperature and humidity conditions as for the drying, i.e. a temperature of 22+/−2° C. and a relative humidity of 50+/−5%.

The specimens are drawn at a speed of 20 mm/min and the distance between the jaws is 50+/−1 mm.

In other words, advantageously, the composition according to the invention has in the dry state an ultimate strain $\varepsilon_r$ of greater than or equal to 15%, and preferably greater than or equal to 25%.

The ultimate strain is determined by tensile tests performed on a sample of a composition according to the invention in the form of a film about 200 μm thick.

To perform these tests, the film is cut into dumbbell-shaped specimens with a working length of 33±1 mm and a working width of 6 mm. The cross section (S) of the specimen is then defined as S=width x thickness ($cm^2$); this cross section will be used for calculating the stress.

The tests are performed, for example, on a tensile testing machine sold under the name Lloyd® LR5K. The measurements are taken at room temperature (20° C.).

The specimens are pulled at a travelling speed of 33 mm/minute, corresponding to a rate of 100% elongation per minute.

A travelling speed is thus imposed and the elongation ΔL of the specimen and the force F required to impose this elongation are simultaneously measured. These data ΔL and F are used to determine the stress σ and strain s parameters.

A curve is thus obtained of stress $\sigma=(F/S)$ as a function of the strain $\varepsilon=([\Delta]L/L_o)\times100$, the test being performed up to the breaking point of the specimen, $L_o$ being the initial length of the specimen.

The ultimate strain $\varepsilon_r$ is the maximum strain of the sample before the breaking point (in %).

Moreover, the cosmetic composition may exhibit an elastic recovery of less than or equal to 80%, after 40% tensile deformation.

The term "elastic recovery" means the degree of return of a specimen to its initial length after 40% tensile deformation followed by release of the stress. Thus, if the initial length of the specimen is $L_0$, and the length after 40% tensile deformation and release of the stress is $L_{(t)}$, the recovery $R_{(t)}$ at time t from the release is equal to: $100\times(1-((L_{(t)}-L_0)/L_0)/0.4)$.

Thus, if $L_{(t)}=L_0$, then $R_{(t)}=100$.

If $L_{(t)}=1.4\times L_0$, then $R_{(t)}=0$.

The recovery test is performed by first preparing a specimen approximately 200 μm thick, 6 cm long and 1 cm wide. If necessary, the specimen is optionally produced on a support film, the mechanical impact of which is judged to be small compared with the mechanical properties of the specimen.

The specimen is subjected to a tensile deformation of 40% of its length at a speed of 0.1 mm/s. The stress is then released and 1 minute is allowed to pass.

The composition is preferably concentrated with respect to solids and consequently has a strong adherence, or a strong "tack". The adherence may be measured as indicated below.

The term "$F_{max}$" means the maximum tensile force, measured using an extensometer, required to detach the respective surfaces, of 38 $mm^2$, of two rigid, inert, non-absorbent supports (A) and (B) placed opposite each other. Surface A is precoated with said composition in a proportion of 519 $\mu g/mm^2$, dried for 24 hours at 22° C. under a relative humidity of 50%. Surface B is uncoated. The two surfaces are then subjected, for 20 seconds, to a compression of 3 newtons and finally subjected, for 30 seconds, to a tensile strain at a speed of 20 mm/minute. The tensile force $F_{max}$ required to separate two surfaces of two rigid, inert and non-absorbent supports placed opposite each other, said surfaces being coated with the styling material to be evaluated, is determined using an extensometer, for example an apparatus of the Lloyd type, model LR5K. The rigid, inert and non-absorbent solid supports are typically a plastic of the glass type. According to the invention, the force $F_{max}$ is preferentially greater than 1 N and preferably greater than 4 N.

Thus, the cosmetic composition comprises at least 20% by weight of solid(s), preferably at least 50% by weight of solid(s), relative to the total weight of the composition.

In particular, the cosmetic composition comprises at least one compound chosen from a wax, for example carnauba wax, beeswax and paraffin wax, an oil, a gum such as gum arabic, a modelling clay, a long-chain organic compound, such as cetyl phosphate, a polymer which has a $T_g$ ranging from −20° C. to 20° C., and mixtures thereof.

In the context of the present invention, the $T_g$ (or glass transition temperature) values indicated are theoretical $T_g$ values determined from the theoretical $T_g$ values of the constituent monomers of the polymer, which may be found in a reference manual such as the Polymer Handbook, 3rd Edition, 1989, John Wiley, according to the following relationship, known as Fox's law:

$$\frac{1}{T_g} = \sum_i \frac{\omega_i}{T_{g_i}}$$

$\omega_i$ being the mass fraction of the monomer i in the block under consideration and $T_{gi}$ being the glass transition temperature of the homopolymer of the monomer i.

Thus, unless otherwise mentioned, the $T_g$ of the polymers in the present application are theoretical $T_g$ values.

Wax

Particularly suitable as waxes are those that were previously described.

In this variant, carnauba wax, beeswax and paraffin wax may be mentioned as particularly advantageous wax.

Oil

As oils that are suitable for use in the invention, mention may be made of:

- hydrocarbon-based oils of animal origin,
- hydrocarbon-based oils of plant origin, synthetic ethers containing from 10 to 40 carbon atoms, such as dicaprylyl ether,
- synthetic esters, for instance oils of formula $R_1COOR_2$, in which $R_1$ represents a linear or branched fatty acid residue containing from 1 to 40 carbon atoms, and $R_2$ represents a hydrocarbon-based chain that is especially branched, containing from 1 to 40 carbon atoms provided that $R_1+R_2\geq10$. The esters may be chosen especially from fatty acid alcohol esters, for instance cetostearyl octanoate, isopropyl alcohol esters such as isopropyl myristate or isopropyl palmitate, ethyl palmitate, 2-ethylhexyl palmitate, isopropyl stearate, octyl stearate, hydroxylated esters, such as isostearyl lactate or octyl hydroxystearate, alkyl or polyalkyl ricinoleates, hexyl laurate, neopentanoic acid esters, such as isodecyl neopentanoate or isotridecyl neopentanoate, and isononanoic acid esters, such as isononyl isononanoate or isotridecyl isononanoate, polyol esters and pentaerythritol esters, such as dipentaerythrityl tetrahydroxystearate/tetraisostearate, fatty alcohols that are liquid at room temperature, bearing a branched and/or unsaturated carbon-based chain containing from 12 to 26 carbon atoms, for instance 2-octyldodecanol, isostearyl alcohol and oleyl alcohol, higher $C_{12}$-$C_{22}$ fatty acids, such as oleic acid, linoleic acid and linolenic acid, and mixtures thereof, non-phenyl silicone oils, for instance caprylyl methicone, and phenyl silicone oils, for instance phenyl trimethicones, phenyl dimethicones, phenyltrimethylsiloxydiphenylsiloxanes, diphenyl dimethicones, diphenylmethyldiphenyltrisiloxanes, and 2-phenylethyl trimethylsiloxysilicates, dimethicones or phenyl trimethicone with a viscosity of less than or equal to 100 cSt, trimethylpentaphenyltrisiloxane, and mixtures thereof, and also mixtures of these various oils.

Gum

By way of gum suitable for the present invention, mention may be made of gum arabic, gum tragacanth, cassia gum, gamboge, shellac, karaya gum, tara gum or gellan gum.

In the context of the present invention, mention may be made of gum arabic as particularly advantageous gum.

Modelling Clay

As modelling clays that are suitable for use in the present invention, mention may be made of platicine, plastiline or else castilene. They are characterized by their malleability and the fact that they do not dry out and thus retain their malleability.

Long-Chain Organic Compound

By way of organic compound suitable for the present invention, mention may in particular be made of oils comprising long carbon-based chains, in particular of $C_{18}$ and more.

In the context of the present invention, mention may be made of cetyl phosphate as particularly advantageous long-chain organic compound.

Polymer with a $T_g$ Ranging from −20° C. to 20° C.

As polymer with a $T_g$ ranging from −20° C. to 20° C. that is suitable for use in the present invention, mention may be made of polypropylenes, or else acrylic and methacrylic polymers, polyurethanes, polyester of higher $T_g$, but for which the $T_g$ of the final material has been reduced via the use of a plasticizer.

In particular, mention may be made of the sulfonic polyester sold especially under the name Sulfonic Polyester AQ 1350 by the company Eastman Chemicals, the $T_g$ of which is in the region of 0° C.

The composition may, under pressure, deform and hug the shape of the keratin fibre(s), in particular human keratin fibre(s), introduced into the mould cavity or cavities.

It deforms plastically under compression, i.e. it at least partly retains the deformation that it is given by the mould.

The moulding device is, in this case, preferably suitable for compression. Thus, the device may comprise one or more compression-deformable mould parts. The mould part(s) may thus comprise at least one elastically deformable material, in particular an elastomeric material and/or a plastic.

Colorant

In the set of variants A to D described previously, it is advantageous for the composition preferably to comprise at least one colorant, which is in particular black in colour, or of another colour or several other colours.

New two-coloured or multicoloured effects may in particular be created.

The composition may be substantially the same colour as those of the additional fibres where appropriate.

This (or these) colorant(s) are preferably chosen from pulverulent dyes, liposoluble dyes and water-soluble dyes, and mixtures thereof.

Preferably, the compositions according to the invention comprise at least one pulverulent colorant. The pulverulent colorants may be chosen from pigments and nacres, and preferably from pigments.

The pigments may be white or coloured, mineral and/or organic, and coated or uncoated. Among the mineral pigments, mention may be made of metal oxides, in particular titanium dioxide, optionally surface-treated, zirconium, zinc or cerium oxide, and also iron, titanium or chromium oxide, manganese violet, ultramarine blue, chromium hydrate and ferric blue. Among the organic pigments that may be mentioned are carbon black, pigments of D & C type and lakes based on cochineal carmine or on barium, strontium, calcium or aluminium.

The nacres may be chosen from white nacreous pigments such as mica coated with titanium or with bismuth oxychloride, coloured nacreous pigments such as titanium mica with iron oxides, titanium mica with in particular ferric blue or chromium oxide, titanium mica with an organic pigment of the abovementioned type, and also nacreous pigments based on bismuth oxychloride. Examples of nacres that may also be mentioned include natural mica covered with titanium oxide, with iron oxide, with natural pigment or with bismuth oxychloride.

Among the nacres available on the market, mention may be made of the nacres Timica, Flamenco and Duochrome (based on mica) sold by the company Engelhard, the Timiron nacres sold by the company Merck, the Prestige mica-based nacres, sold by the company Eckart, and the Sunshine synthetic mica-based nacres, sold by the company Sun Chemical.

The nacres may more particularly have a yellow, pink, red, bronze, orange, brown, gold and/or coppery colour or glint.

The liposoluble dyes are, for example, Sudan Red, D&C Red 17, D&C Green 6, β-carotene, soybean oil, Sudan Brown, D&C Yellow 11, D&C Violet 2, D&C Orange 5, quinoline yellow and annatto.

Preferably, the pigments contained in the compositions according to the invention are chosen from metal oxides.

A composition according to the invention may also comprise at least one particulate or non-particulate, water-soluble or water-insoluble colorant, preferably in a proportion of at least 0.01% by weight relative to the total weight of the composition.

For obvious reasons, this amount is liable to vary significantly with regard to the intensity of the desired colour effect and of the colour intensity afforded by the colorants under consideration, and its adjustment clearly falls within the competence of a person skilled in the art.

These colorants may be present in a content ranging from 0.01% to 30% by weight relative to the total weight of the composition and in particular from 6% to 22% by weight relative to the total weight of the composition.

Preferably, the colorant(s) are chosen from one or more metal oxides that are present in a content of greater than or equal to 2% by weight relative to the total weight of the composition, and advantageously inclusively between 6% and 22% by weight relative to the total weight of the composition.

BRIEF DESCRIPTION OF THE DRAWINGS

The invention may be better understood on reading the following detailed description of non-limiting exemplary embodiments thereof and on examining the attached drawing, in which:

FIG. 26 represents the device of FIGS. 25A and 25B, the housings for receiving the fingers having been taken away, FIG. 38 represents an example of an injection channel communicating with mould cavities, FIGS. 39A, 39B and 39C illustrate various steps of an example of compression moulding, and FIGS. 40A and 40B illustrate an example of mould compression.

DETAILED DESCRIPTION

Figure 1:
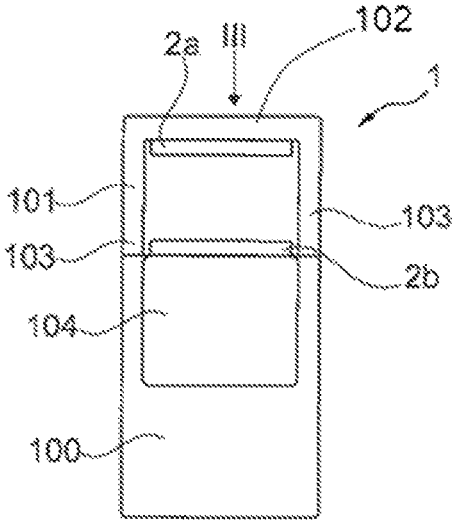
FIG. 1 represents an example of a moulding device according to the invention, in the open position.
Figure 2:
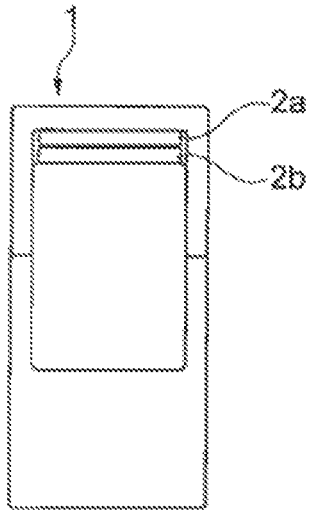
FIG. 2 represents the device of FIG. 1, in the closed position.
Figure 3:
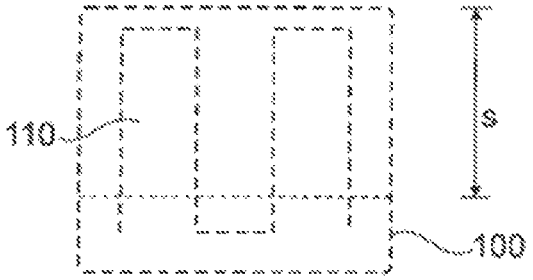
FIG. 3 represents the device of FIG. 1, in top view along the arrow III.

The moulding device 1 represented in FIGS. 1 to 3 comprises a case 100 that can be manipulated by the user, with a frame 101 whose upper part 102 bears a first jaw with a first mould part 2*a*.

The frame 100 has uprights 103 between which can move a second jaw with a second mould part 2*b*, borne by a slide rail 104.

This slide rail may be moved between a bottom position, represented in FIG. 1, for insertion of the eyelashes between the jaws, and a top position, illustrated in FIG. 2, in which the two mould parts 2*a*, 2*b* are close or in contact to mould the composition on the eyelashes. The two jaws may be solicited in the open position by a spring, which is not shown.

The lower jaw bearing the mould part 2*b* has, as may be seen in FIG. 3, an electrical resistance 110 running through it, which extends, for example, forming niches.

The lower jaw may overhang relative to the case 100 over a distance s, as may the upper jaw.

The electrical resistance 110 is, for example, 10 cm long.

Each of the lower and upper jaws preferably comprises a metal plate, for example made of aluminium.

The aluminium plate which bears the lower mould part 2*b* is, for example, 2 cm wide and 2 cm long. This plate is fixed by bonding with the electrical resistance on the slide rail 104.

The course in the upward movement of the lower mould part 2*b* between the configurations of FIGS. 1 and 2 is, for example, between 1 and 3 cm and preferably about 2 cm.

The intensity of the current passing through the electrical resistance 110 is chosen, for example, so as to obtain a temperature of 80° C. in the aluminium plate of the lower jaw in less than 20 seconds, from an initial temperature of 24° C. in an environment at 24° C.

Figure 4:
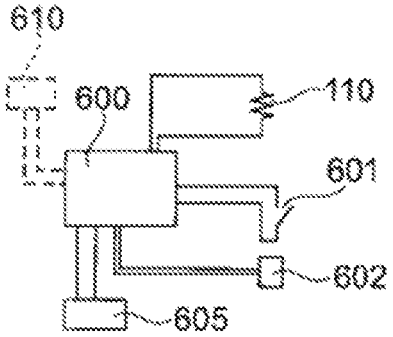
FIG. 4 represents schematically the electronic circuit of the device of FIGS. 1 to 3.

The case 100 may house an electronic circuit 600 for controlling the functioning of the device 1 represented schematically in FIG. 4.

In the example considered, an electrical contactor 601 is actuated immediately on the upward movement of the lower jaw to allow the electronic circuit 600 to be informed thereof, and a temperature probe 602 is incorporated into the lower jaw so that its temperature can be known.

The device 1 may incorporate a vibrator 605 controlled by the electronic circuit 600. This vibrator is, for example, incorporated into the case 100 close to the frame 103 or to one of the jaws. The vibration frequency is, for example, 100 Hz, and the vibration amplitude is 0.3 mm.

The device 1 may comprise, where appropriate, one or more Peltier elements 610 to accelerate the cooling, incorporated into the jaws.

Figure 6:
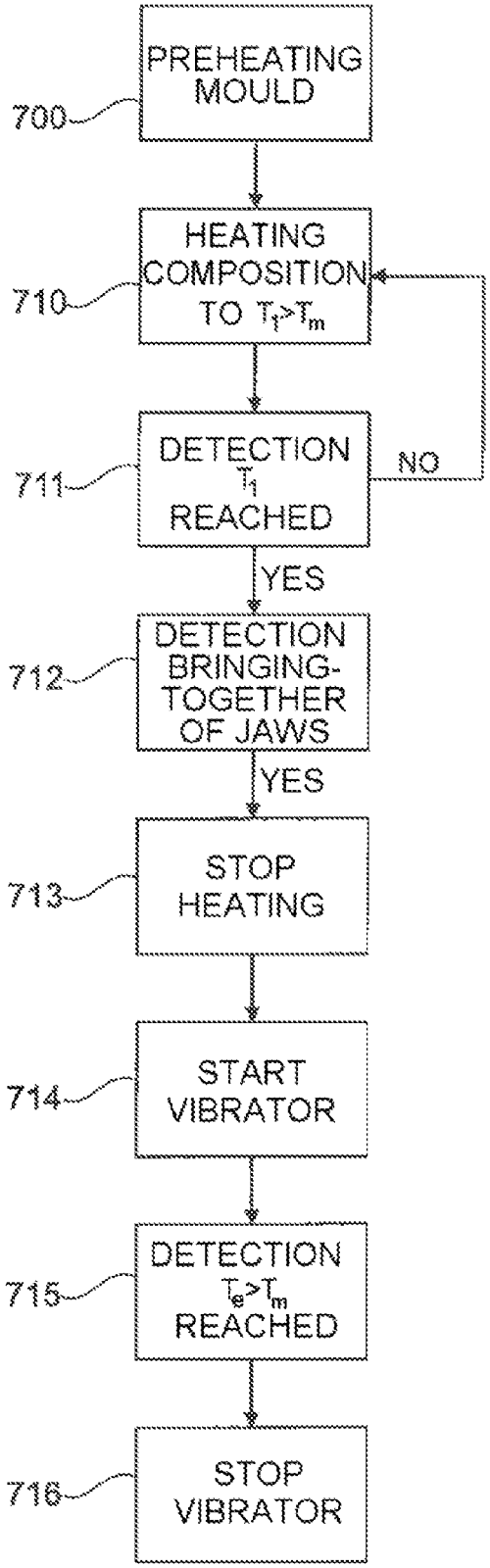
FIG. 6 represents various steps in the process performed with the device of FIGS. 1 to 3 in the case of using a hot-melt composition.

The electronic circuit 600 comprises a controller arranged, as illustrated in FIG. 6, so as, in a first step 700, to maintain the temperature of the mould at a nominal preheating value $T_m$, for example less than or equal to 15 degrees Celsius below the melting point of the cosmetic composition.

This preheating may be applied only to the mould part in which the composition is received before closing the mould, especially when the composition is received only in the imprints of one of the mould parts, for example the lower part 2*b* as in the example of FIGS. 1 and 2. In this case, preheating is performed only on the lower mould part.

When the user triggers the heating of the composition at a temperature $T_1$ above $T_m$, for example more than 5° C. above the melting point $T_m$ of the composition, in step 710, the electronic circuit 600 regulates the current in the heating resistance 110 so as to reach the temperature $T_1$ and then maintain it in step 711.

An indication that the temperature $T_1$ has been reached may be given to the user, for example, by a sound and/or visual signal, for example the lighting of an indicator lamp on the case 100.

The user positions his eyelashes between the mould parts 2*a* and 2*b* and, when he considers that the positioning is correct, he closes the mould at time $t_1$ by moving the slide rail 104 to bring the mould part 2*b* close to the other part 2*a*.

The bringing-together of the jaws is detected in step 712 by means of the contactor 601, which changes state. The electronic circuit 600 is arranged so as, in this case, to stop the heating in step 713 and, where appropriate, in the presence of one or more Peltier elements 610, to accelerate the cooling using these elements.

Figure 5:
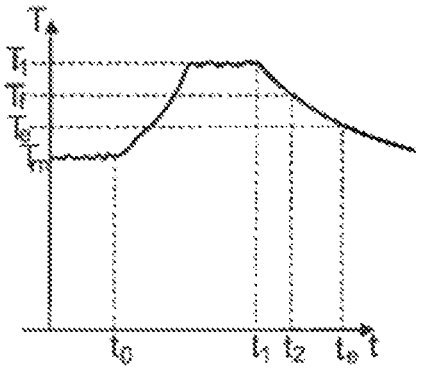
FIG. 5 represents the temperature change in the case of using a hot-melt composition with the device of FIGS. 1 to 3.

FIG. 5 shows the change in temperature T between time $t_0$ when the user triggers the heating of the composition to reach the value $T_1$ and the time $t_1$ when the bringing-together of the jaws of the mould parts commences.

Immediately after stopping the heating at time $t_1$, the vibrator 605 is switched on, when it is present in the device 1.

Cooling of the composition is performed, the melting point is passed at time $t_2$ and the temperature reaches a value $T_e$ at time $t_e$ with $T_e<T_m$.

The user can then be informed that the composition is set by the emission of a sound and/or visual signal, for example the lighting of a corresponding indicator lamp on the case 100.

When the temperature $T_e$ is reached, the switching-off of the vibrator 605 may be controlled by the circuit 600 in step 716 and the user can open the mould parts to remove the eyelashes.

Figure 7:
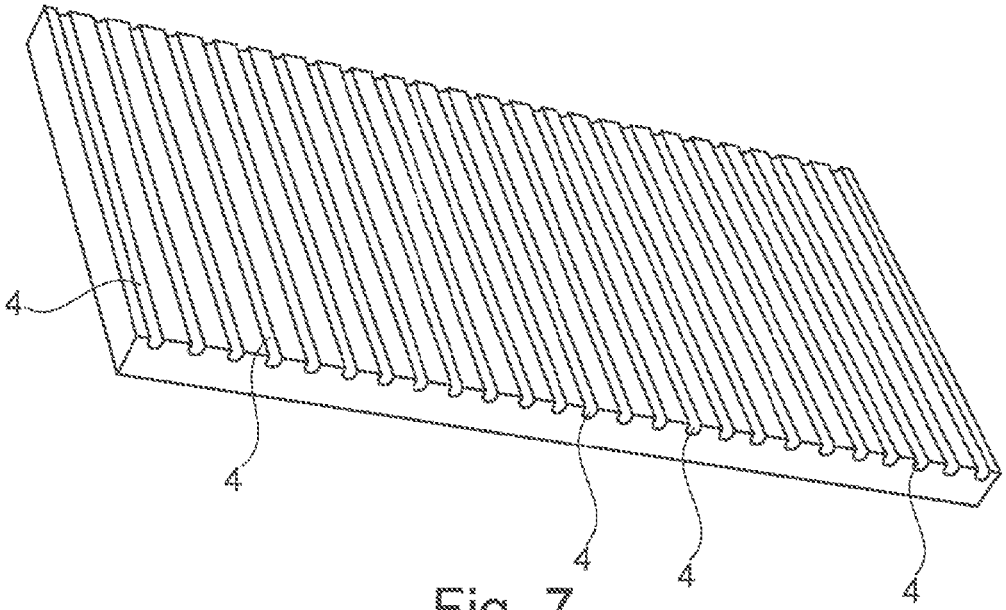
FIG. 7 represents a mould part with imprints allowing the formation of rectilinear moulding cavities.

This process, which corresponds to the fourth aspect of the invention above, is performed with a hot-melt composition as described in chapter A above and with eyelash moulding cavities that may have any shape, and may especially originate from mould parts having rectilinear and parallel imprints 4 as illustrated in FIG. 7.

However, this process is advantageously performed with mould parts made in accordance with the first, second or third aspect of the invention.

Figure 8:
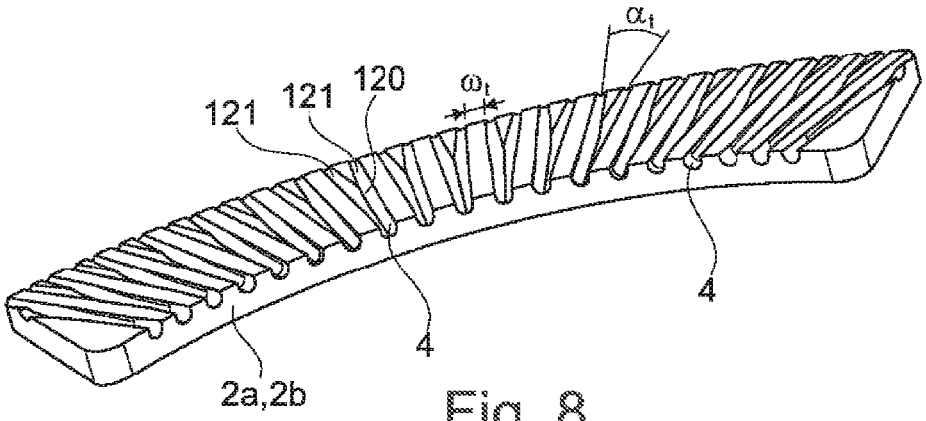
FIG. 8 is a perspective view of an example of a mould part for producing an enhanced eyelash effect with points directed outwards.

FIG. 8 thus shows a mould part 2*a* or 2*b* for forming multiple points by moulding the composition on the eyelashes, for example using the device 1 represented in FIGS. 1 to 3.

Each individual imprint 4 of the mould part has on the proximal side a single-strand section and which is divided into two at a branching 120 to form two branches 121 also known as tips.

Thus, viewed from above, the mould part has imprints for receiving the eyelashes, which are each Y-shaped.

The branching 120 is located, for example, along the individual cavity at a distance from the proximal end thereof that is between 1/3 and 2/3 of its length, the branching preferably being located as illustrated more than halfway along the length of the cavity.

During the use of a mould comprising such a mould part, the eyelashes may be introduced into each individual cavity over a length less than the distance separating the branching 120 from the inlet of the cavity on the proximal side, so as to form a double tip for each eyelash introduced into an individual cavity.

Figure 9:
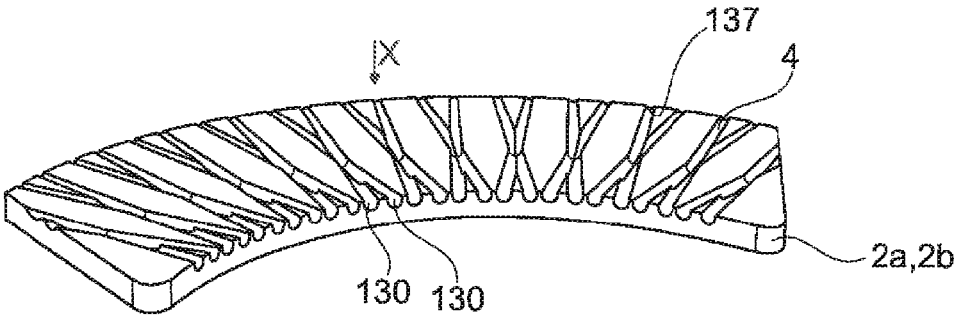
FIG. 9 is a view similar to FIG. 8 of an embodiment variant of the mould part.
Figure 10:
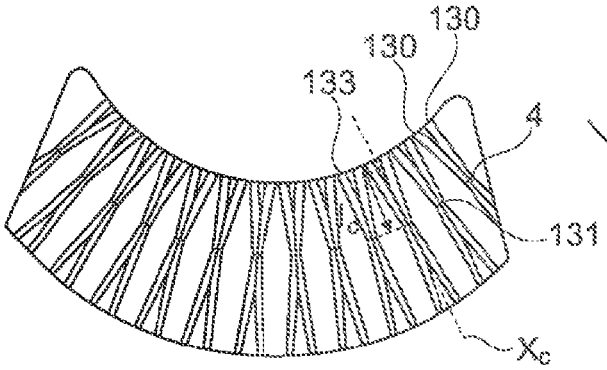
FIG. 10 is a top view along the arrow X in FIG. 9.

Multiple tips may also be made with X-shaped imprints 4, as illustrated in FIGS. 9 and 10.

It is seen therein that each imprint comprises two branches 130 which cross at a branching 131 located, for example, between 1/3 and 2/3 of the length of the cavity measured along its longitudinal axis Xc.

In the example considered, this branching 130 is at a distance $l_c$ from the proximal end 133 of the cavity that is less than half of its length, measured along the longitudinal axis of the cavity.

Figure 35:
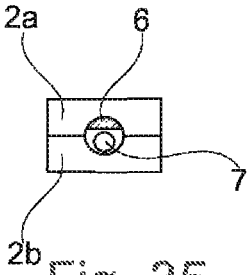
FIGS. 35 and 36 represent a cavity comprising an eyelash and a cavity comprising several eyelashes.

The cross section of each branch 130 may decrease towards its distal end 137 as illustrated in FIG. 35.

In the example considered, each branch 130 is rectilinear, but, in a variant not shown, may use non-rectilinear branches, which cross.

During use, the eyelashes are each at least partially introduced into only one of the branches of an X-shaped unit, or, as a variant, two successive eyelashes are introduced into the two branches of the same unit.

Figure 11:
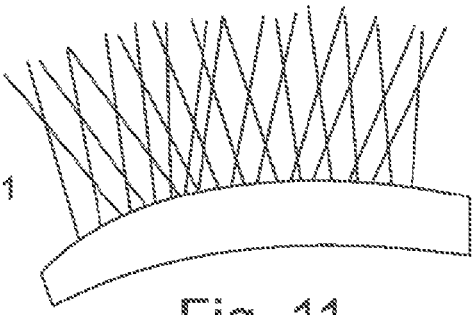
FIG. 11 represents another example of formation of branchings during moulding.

A mould may be made with cavities that cross at several points, so as to form a grid on the eyelashes, as illustrated in FIG. 11. In this figure, only the result of the moulding has been represented, without showing the eyelashes. Such a grid may contribute towards flattening the eyelash fringe and thus disciplining it, especially in the presence of shaggy eyelashes. The mould may comprise on each mould part an imprint that constitutes a half-grid. The eyelashes are sandwiched between the two half-grids closed on the two mould parts.

It is seen in FIG. 11 that the mould may comprise cavities for making X-shaped units and other cavities for inverted V-shaped units or rectilinear branches that converge towards the exterior, without joining together.

Figure 12:
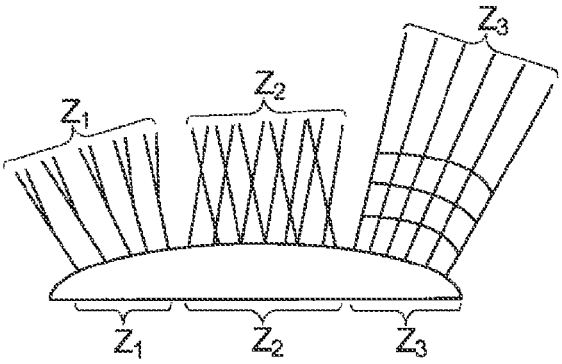
FIG. 12 illustrates an example of evolutive makeup.

It is possible in accordance with the second aspect of the invention to make mould cavities whose shape and/or spacing or orientation changes along the mould, so as to allow the formation, on the eyelashes, of moulded units that vary along the eyelash fringe, as illustrated in FIG. 12. In this figure, the eyelashes themselves have not been shown, for the sake of clarity.

There may thus be on a first zone Z1 a first type of unit formed on the eyelashes, and then along a zone Z2 a second type of unit, and finally along a zone Z3 a third type of unit, all the units being different.

Figure 13:
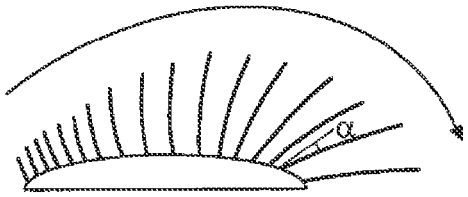
FIGS. 13 to 15 are views similar to FIG. 12 of other examples of evolutive makeup.

FIG. 13 illustrates evolutive makeup corresponding to a mould cavity length which tends to increase along the baseline from one end to the opposite end.

The length may increase uniformly or non-uniformly.

The angle $\alpha$ of the moulded unit relative to the normal to the eyelid may also change, for example increasing with the length of the cavities. The angle α passes, for example, from 0° to 30° as the length increases. The length of the moulded units passes, for example, from 3 mm to 15 mm.

Figure 14:
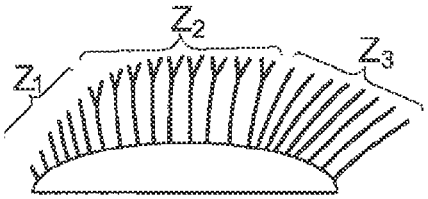

FIG. 14 represents a multizone evolutive makeup with lateral zones $Z_1$ and $Z_3$ containing rectilinear cavities, of different lengths, and a central zone $Z_2$ containing Y-shaped units.

Figure 15:
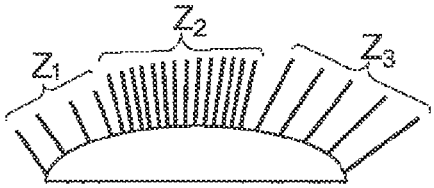

FIG. 15 represents evolutive makeup in which the density of moulded units along the baseline varies, for example being substantially the same for the side zones $Z_1$ and $Z_3$ and higher for the central zone $Z_2$.

Figure 16:
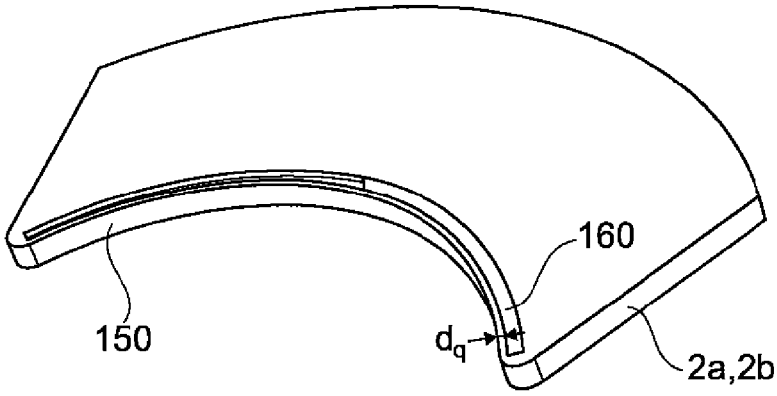
FIG. 16 represents an example of a mould part for forming a concave composition strip on the eyelashes.
Figure 17:
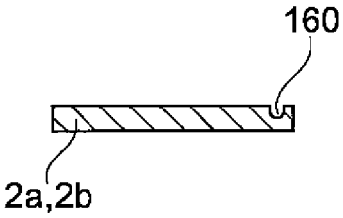
FIG. 17 is a cross section of the mould part of FIG. 16.

FIGS. 16 and 17 represent a variant of mould part 2*a* or 2*b* intended for forming a composition strip moulded on the eyelashes, in accordance with the third aspect of the invention.

The mould part comprises, preferably close to its proximal edge 150 as illustrated, a groove 160, also known as a gutter, which is concave towards the proximal edge 150. This groove 160 is curvilinear and follows the curvilinear shape of the proximal edge 150 of the mould part.

Figure 18:
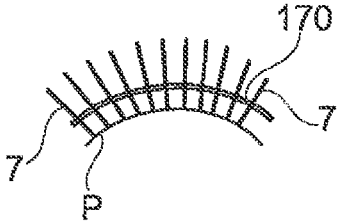
FIG. 18 illustrates an eyelash fringe onto which the strip has been moulded.

Such a groove 160 allows the formation by moulding on the eyelashes 7 of a composition strip 170 which has a curvilinear shape, as illustrated in FIG. 18 and which follows the contour of the eyelid P or of the adjacent eyebrow arch.

The mould part may comprise only this curvilinear groove 160 so as to form only the composition strip on the eyelashes to connect them together and contribute towards disciplining them.

Each mould part may comprise a single groove 160, the two grooves superposing when the two mould parts are placed in contact on the eyelashes, and a cavity for moulding a single composition strip.

As a variant, only one of the mould parts, preferably the lower part 2*b*, comprises the groove 160, the other being free of such a groove.

The groove 160 is preferably made a short distance $d_g$ from the proximal edge 150, preferably with $d_g \leq 2$ mm, better still 1 mm.

Figure 19:
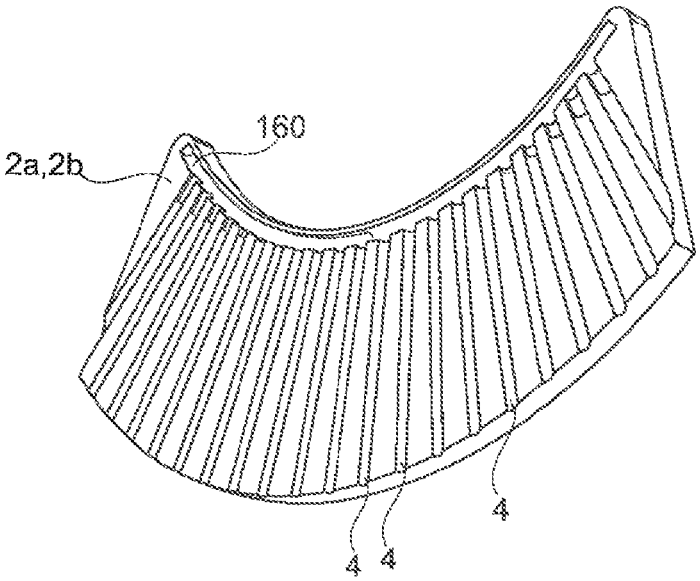
FIG. 19 represents an embodiment variant of the mould part.

As illustrated in FIG. 19, the mould part 2*a* or 2*b* may comprise, besides the abovementioned groove 160, a plurality of individual imprints 4 for receiving the eyelashes, which not only allow the formation by moulding of the composition strip 170, but also the moulding of the composition on each eyelash, so as to coat them and/or to form multiple branches or extensions, as detailed previously, with the proviso of adapting the shape that is suitable.

Figure 20:
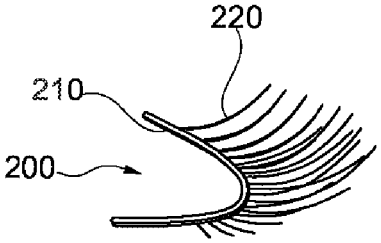
FIG. 20 represents an article comprising a preformed curvilinear composition strip, in accordance with the third aspect of the invention.

It is possible to make outside the eyelash fringe, with mould parts 2*a*, 2*b* as illustrated in FIG. 19, an article 200 comprising a preformed composition strip 210, bearing a plurality of fibres 220 as illustrated in FIG. 20.

Such an article 200 may be applied after its manufacture onto an eyelash fringe by at least partially melting the composition strip using a heating applicator device, similar to an eyelash curler, for example. This makes it possible, on the one hand, to obtain a liner effect on the eyelid, by the proximity or contact of the composition strip 210 with the eyelid or the skin of the eyebrow arch, and, on the other hand, due to the presence of the fibres 220, to increase the eyelash density.

Figure 21:
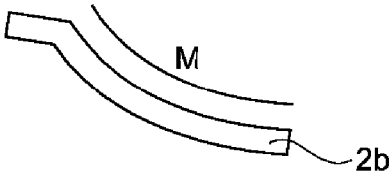
FIG. 21 represents in cross section an example of an incurved mould part.

It is seen that the lower mould part 2*b* can be incurved, where appropriate, as illustrated in FIG. 21, so as to reproduce the incurved shape of the eyelashes, the radius of curvature preferably being between 15 and 25 mm.

The proximal edge of the mould part 2*b* intended to come into contact with the eyelid may have a radius of curvature of between 15 and 25 mm.

Figure 22:
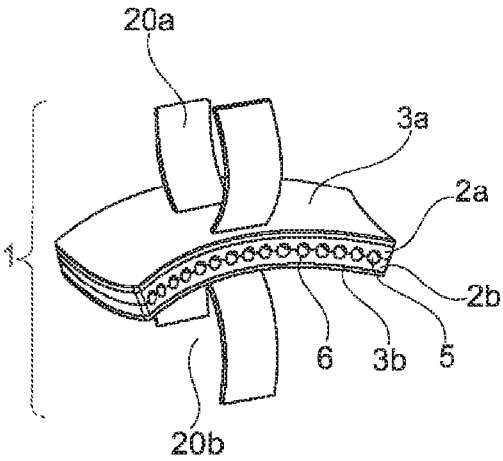
FIGS. 22 and 23 represent another example of an assembly according to the invention, in the form of a clamp, respectively with the jaws of the mould closed in moulding configuration and open.
Figure 23:
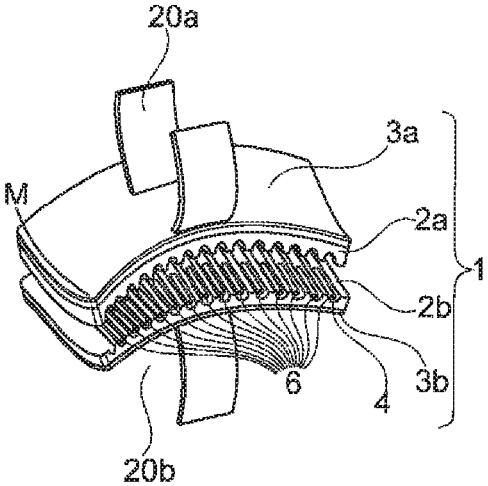

The device 1 may be, according to one implementation variant of the invention, in the form of a clamp, as represented in FIGS. 22 and 23.

Like the device represented in FIGS. 1 to 3, this device in the form of a clamp comprises a mould 2 in two parts 2*a* and 2*b* made of elastomer. The two parts 2*a* and 2*b* of the mould 2 each have, for example, a thickness e of about 2 mm. The two parts 2*a* and 2*b* of the mould 2 comprise imprints 4 suitable for performing the invention according to its first or its second aspect, for example. The device 1 comprises two jaws 3*a* and 3*b* which carry respectively the mould parts 2*a* and 2*b*. The functioning may take place in the same manner as described in reference to FIG. 6 so as to perform the invention according to its fourth aspect.

Each part 2*a*, 2*b* comprises, for example, about fifteen imprints 4, for example having a width l of about 0.5 mm, a length L of about 2.5 cm, and a decreasing semicircular cross section over at least part of their length, so as to give the eyelashes, once moulded with the composition 6, a tapered appearance. The imprints 4 of each part 2*a*, 2*b* of the mould 2 are preferably, as illustrated, substantially parallel to each other at least on the proximal side of the mould. The imprints may be evenly spaced out, according to a step p of 1.5 mm, centre to centre.

The mould 2*a*, 2*b* may have a radius of curvature in the direction M of FIG. 23 of between 15 and 25 mm so as to follow the shape of the eyelashes. The edge of part 2*b* intended to come into contact with the eyelid may have a rounded shape, concave towards the exterior, with a radius of curvature preferably between 15 and 25 mm.

The edge of the jaws 3*a*, 3*b* and of the mould 2*a*, 2*b* intended to come into contact with the eyelid may have a rounded shape, concave towards the exterior, in particular circular, the edge of the eyelid describing, to a first approximation, an arc of a circle.

When the jaws are closed against each other, as represented in FIG. 22, cavities 5 are formed by means of the imprints 4, which are superimposed in pairs. About fifteen cavities 5 are thus created, for example. The cavities 5 are closed on the sides and open out to the exterior, on the proximal front side where the eyelashes are introduced, via a circular opening through which the eyelashes are introduced. The cavities may be closed at their rear distal end.

The device 1 in the form of a clamp may comprise, as illustrated, two housings 20*a*, 20*b* into which fingers of one hand, for example the thumb and the index finger, can be introduced so as to move the two jaws 3*a*, 3*b* apart, in order to make it possible to introduce the eyelashes between them and to close them on said eyelashes.

The cosmetic composition 6 to be moulded is placed in imprints 4 of part 2*b* of the mould 2 before introduction of the eyelashes. The composition 6 is preferably a cosmetic composition having a melting point of between 40° C. and 120° C., and comprising at least 15% by weight of meltable compound(s), relative to the total weight of the composition, as previously described.

Only one of the mould parts can have imprints, which is particularly advantageous for a device 1 devoid of a guidance system, since the bringing together of the two parts of the mould does not need to be performed very accurately.

Figure 24:
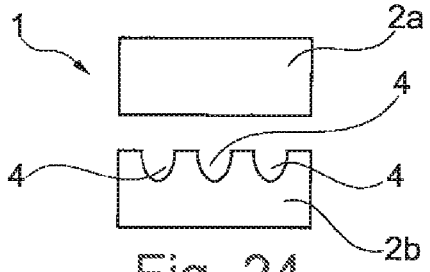
FIG. 24 represents schematically an example of a mould before closing.

By way of example, FIG. 24 represents a device 1 in which part 2*a* of the mould 2 is smooth and part 2*b* comprises semicircular imprints 4.

Moreover, each cavity 5 may have an elongated shape which does not reproduce the curvature of the eyelash(es) introduced, it being possible in particular for the cavity to be non-curved along its longitudinal direction, having, for example, a rectilinear longitudinal axis.

The device 1 in the form of a clamp may comprise a guidance system, for example in the form of reliefs having complementary shapes, which brings the jaws 3*a*, 3*b* into position so that the two parts of the mould 2*a*, 2*b* accurately correspond to each other. The device 1 in the form of a clamp may thus comprise, for example, a male and female cone guidance system.

Figure 25A:
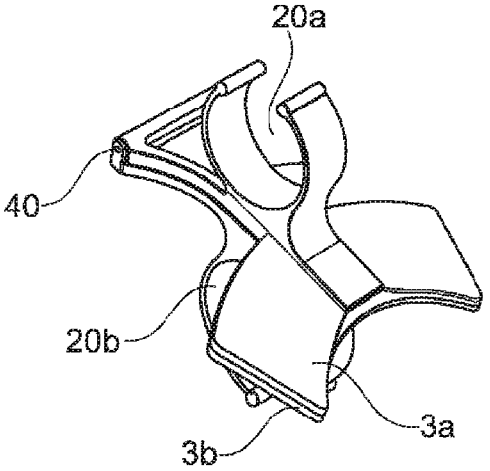
FIGS. 25A and 25B, 26, 27 and 28 represent other examples of devices according to the invention in the form of a clamp, the moulds not being represented, FIGS. 25A and 25B illustrating the same example of a device respectively with the jaws closed and open.
Figure 25B:
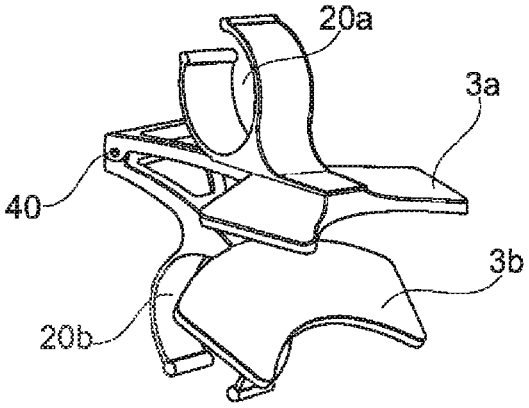

The device 1 in the form of a clamp may comprise a guidance system of film hinge type or other form of articulation 40, as represented in FIGS. 25A and 25B, such that the jaws can be moved together by a pivoting movement relative to each other. Each cavity formed by the superposition of two imprints may have a rectilinear longitudinal axis. The front edges of the jaws 3*a*, 3*b* intended to come into contact with the eyelid may have a circular shape, as illustrated.

Figure 26:
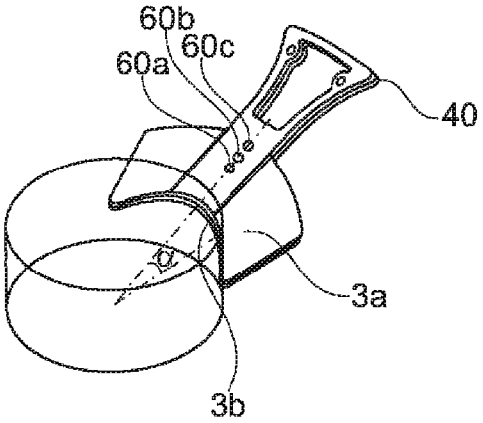

During the use of the device 1, the angle $\alpha$ made by the moulding plane with the horizontal may be zero or non-zero, in particular between 20 and 40°, as illustrated in FIG. 26. Inclining the plane of the moulds makes it possible to push the curvature of the edge coming into contact with the eyelid as close as possible to the curvature of the eyelid itself.

Figure 27:
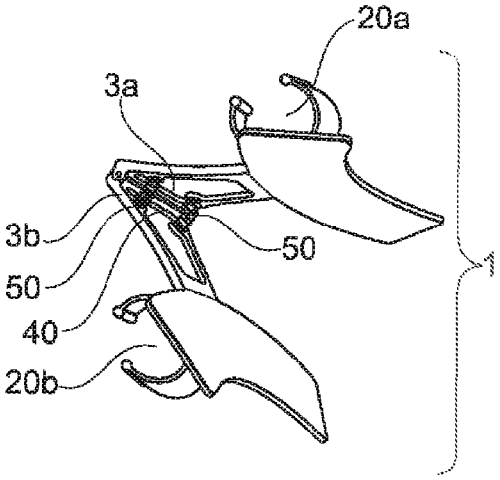

The hinge 40 may comprise one or more springs 50 as represented in FIG. 27, which assist the opening movement for example.

Figure 28:
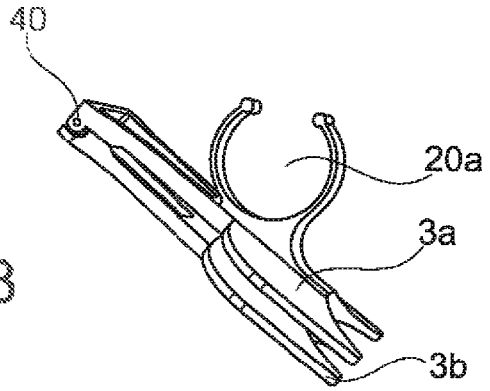

The device 1 in the form of a clamp may comprise a single housing 20*a* for receiving a finger, as illustrated in FIG. 28, or two housings, as previously described.

It may be possible for the housing(s) 20*a*, 20*b* to be oriented rotationally, which enables an adjustment according to the angle between the user's thumb and index finger. They may be positionable, where appropriate, at various points 60*a*, 60*b* or 60*c*, depending on the desired distance between the fingers and the face of the user, as illustrated in FIG. 26.

Each mould part 2*a*, 2*b* may be integrated into the corresponding jaw 3*a*, 3*b*. The device 1 in the form of a clamp may then be made of a flexible material of silicone type for example, in order to facilitate demoulding.

The mould may also be made of a flexible material of silicone type with the inclusion of a rigid frame. The housing(s) 20*a*, 20*b* may be made of a rigid material, so as to improve the holding of the clamps in place and the overall shape of the mould, while facilitating demoulding.

It is possible for the mould 2*a*, 2*b* to not be integrated into the jaws 3*a*, 3*b*. The jaws then bear the mould parts, which are brought close to the jaws. The mould may be flexible and held on the jaws for example by adherence or by matching shapes, for example by click-fastening and/or sliding attachment. The jaws are then preferably rigid.

The mould 2*a*, 2*b* may or may not be disposable. The jaws 3*a*, 3*b* may or may not be reusable.

The composition 6 may be present within the mould before use of the device 1, in part 2*a*, part 2*b* or in both parts. The loading of the mould with composition may be performed prior to the use of the device, for example using a metering device.

The device in the form of a clamp has the advantage of being light, of allowing the user to precisely perceive the stresses applied, to the eyelid, during the operations, of creating a very small visual obstruction allowing optimal vision for the user, and of being easy to use.

Figure 29A:
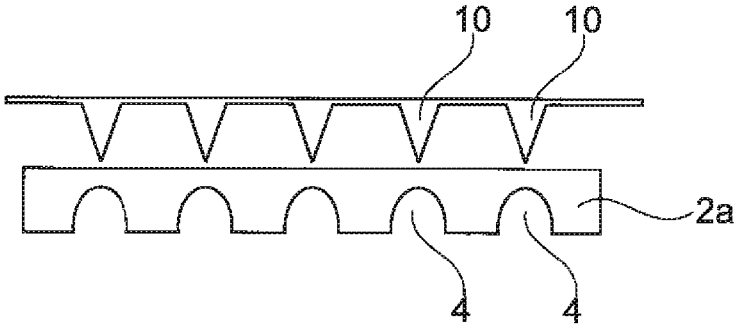
FIGS. 29A and 29B represent various steps in the use of an example of a demoulding system.
Figure 29B:
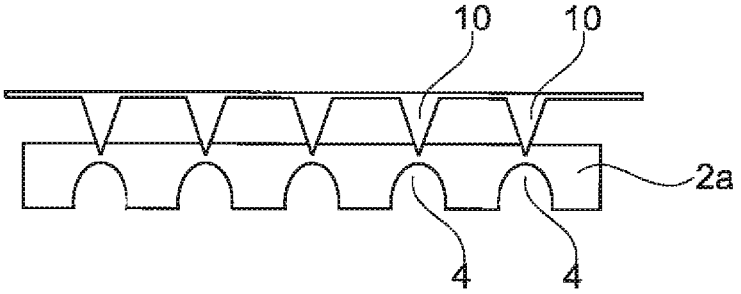

The device 1, whether or not it is in the form of a clamp, may comprise a system which facilitates demoulding, for instance a set of small blades 10 which deform the mould, for example when moved relative to said mould in the direction of the imprints 4, as illustrated in FIGS. 29A and 29B. In the case where it is sought to make a composition strip connecting several eyelashes together in accordance with the third aspect of the invention, care will obviously be taken to ensure that such blades do not section the strip.

Figure 30:
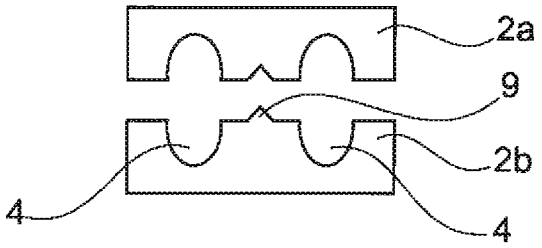
FIG. 30 represents another example of a mould before closing.

The mould 2 may also comprise, as illustrated in FIG. 30, reliefs 9 between two imprints 4 intended to form two cavities, so as to cut any bridges of composition.

Figure 31:
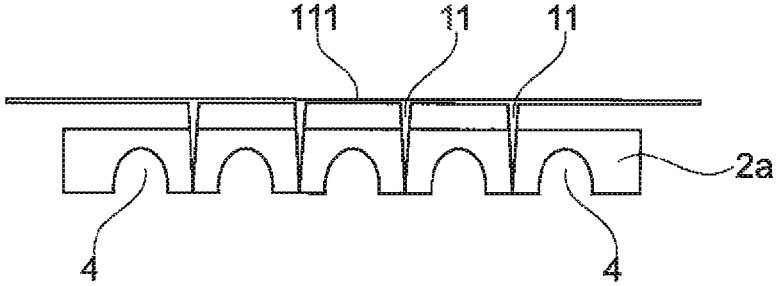
FIG. 31 represents an example of a part of a device equipped with blades.

The device 1 may comprise blades 11 which serve to cut any bridges of composition between two cavities, as illustrated in FIG. 31.

The blades 11 are, for example, retracted within the mould part 2*a* before closing thereof, and tend to advance upon closing of the mould. The blades 11 are, for example, securely fastened to a support 111 which is mobile relative to part 2*a*.

As a variant, the material of part 2*a* is elastomeric and overmoulded on the blades 11, which can push on the bridges of composition extending between the imprints 4 by virtue of the deformability of the material with which part 2*a* is made.

Yet other systems may be used for cutting the bridges, for example a system for sending compressed air via slits located between the imprints or a heating element.

Figure 32:
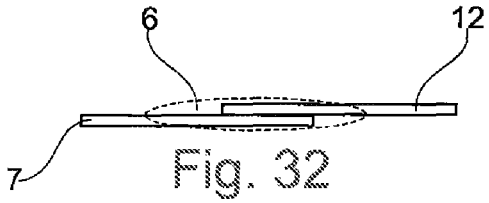
FIGS. 32 and 33 represent two examples of connection of an additional fibre to an eyelash using a composition according to the invention, FIGS. 34A and 34B respectively represent a mould part with fibres on standby, before putting the eyelashes and the composition in place, and the mould part after putting the eyelashes in place and introducing the composition.
Figure 33:
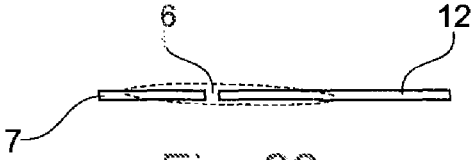

The composition 6 can make it possible to attach an additional fibre 12 to an eyelash 7, with or without axial overlap between the eyelash and the additional fibre, as illustrated, respectively, in FIGS. 32 and 33. The eyelash may be on the additional fibre if the additional fibre is in a cavity of the lower mould part, or vice versa, if the additional fibres are in the cavities of the upper mould part. In practice, the additional fibres may also be next to the eyelashes depending on the organization caused by the pressure of the two parts of the mould.

The additional fibres may in particular be false eyelashes.

Figure 34A:
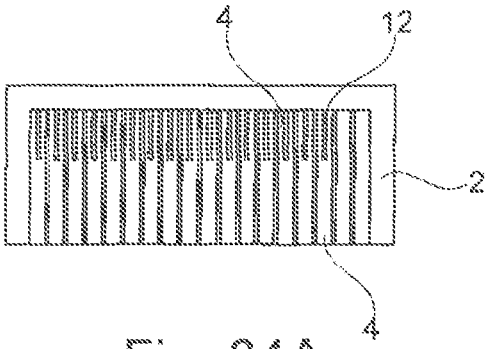
Figure 34B:
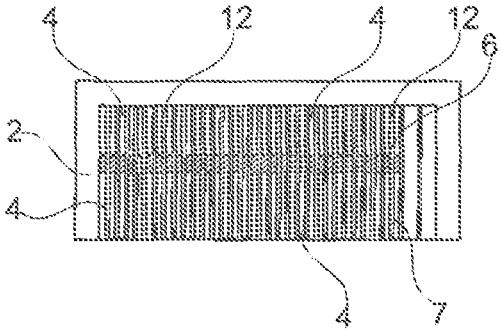

The additional fibres 12 may be placed on hold in the imprints 4 of the mould 2, as illustrated in FIG. 34A. The composition 6 may then be applied to the ends of the additional fibres 12 and the eyelashes 7 introduced into the imprints 4 of the mould 2 and brought into contact with the composition 6 as illustrated in FIG. 34B. The imprints 4 have been represented here as rectilinear, but, as a variant, they may comprise branchings in accordance with the first aspect of the invention, or may be directed towards producing evolutive makeup in accordance with the second aspect of the invention.

The cavities may have, over at least part of their length, a semi-cylindrical shape in the case where part 2*a* of the mould is flat and part 2*b* of the mould is semi-cylindrical in the cavity 5 formation zone, as illustrated in FIG. 24.

Figure 36:
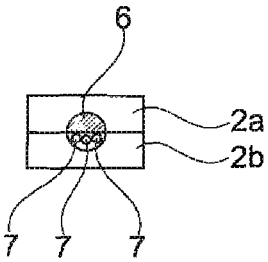

Each cavity 5 can receive one or more eyelashes 7, as illustrated, respectively, in FIGS. 35 and 36.

Figure 37A:
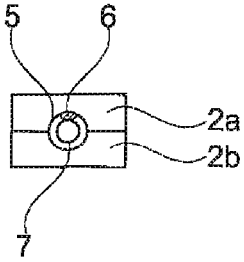
FIGS. 37A to 37E represent, in cross section, examples of arrangements of the composition according to the invention before moulding, within a mould cavity into which an eyelash is introduced.
Figure 37B:
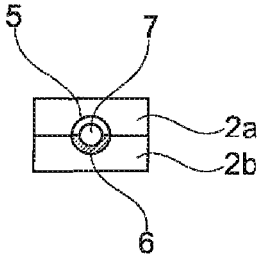
Figure 37C:
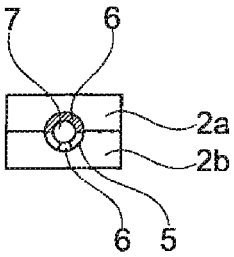
Figure 37D:
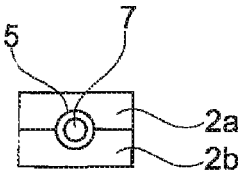
Figure 37E:
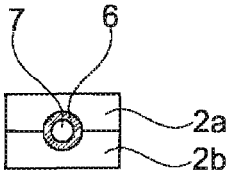

Before moulding, the composition 6 may, according to various variants, be present on only one part of the cavity 5, as represented in FIGS. 37A to 37C, on all of the cavity, as illustrated in FIG. 37E, or absent from the cavity as represented in FIG. 37D. In the latter case, the composition may be injected via an injection channel 8 communicating with the cavities 5 of the mould, as illustrated in FIG. 38.

The composition 6 may be present initially, before putting the eyelashes in place, on the upper part of the cavity, corresponding to mould part 2*a*, as illustrated in FIG. 37A, on the lower part of the cavity, corresponding to mould part 2*b*, as illustrated in FIG. 37B, or both on the upper part and on the lower part of the cavity, corresponding to both parts 2*a* and 2*b* of the mould, as illustrated in FIGS. 37C and 37E.

Except when it is desired to perform the fourth aspect of the invention, the hot-melt composition may be replaced with a cosmetic composition that is fluid at room temperature and that contains at least particles in the dispersed state in a liquid medium.

The device may then comprise or may be placed in proximity to a heating element, the heating element being, for example, a resistive element, a radiative element or a wave dispenser.

The device may comprise or may be placed in proximity to a system which assists drying by providing energy, in particular in the form of light or heat, and/or which comprises an aeration circuit, suction and/or blowing of air, in order to evaporate at least part of the liquid medium.

The mould may comprise an absorber specific for the liquid medium in order to eliminate at least part of the liquid medium.

In another example of implementation of the invention, a composition which is a composition that is fluid at room temperature and contains at least one compound that is activatable via a physical or chemical stimulus is used. The eyelashes and the composition are enclosed in the mould. After reaction, demoulding is performed.

The device may then comprise or be placed in proximity to a heating element so as to accelerate the reaction, the heating element being, for example, a resistive element, a radiative element or a wave dispenser.

The device according to the invention may comprise a triggering system, such as a light element, in order to trigger the reaction, for example an IR, UV or visible light illuminator. The mould is then preferably transparent to the wavelengths used to trigger the reaction.

In another example of implementation of the invention, the composition is a ductile composition and preferably has a Young's modulus of less than or equal to 100 MPa at room temperature and ambient pressure.

FIGS. 39A to 39C illustrate various steps of an example of compression moulding. Composition 6 is initially present in part 2*a* of the mould and the eyelashes 7 in the other part 2*b*.

After closure of the two parts of the mould, the cavities 5 are formed, as illustrated in FIGS. 39B and 39C.

A compression exerted on the mould, which is flexible, makes it possible to reduce the volume of the cavities of the mould, as illustrated in FIG. 39C, and to enhance the contact between the eyelashes 7 and the composition 6.

FIGS. 40A and 40B represent a mould before and after compression of the cavities, without the eyelashes or the composition. The largest dimension of the cavities A is, for example, 3 mm before compression and it is reduced by at least 30%, for example to 2 mm, after compression.

EXAMPLES PROPOSED

Examples 1 to 8: Hot-Melt Composition with a Melting Point of Between 40° C. and 120° C.

Example 1: Assembly Containing a Composition Based on a Thermoplastic Polymer and a Device which has a Heating Element 1) Cosmetic Composition A composition in accordance with the invention is prepared as described below.

All the starting materials used are weighed out using a balance (accuracy 0.01 g). The compounds are melted in a jacketed 500 ml heating pan with circulation of hot oil 5 to control the temperature. The assembly is heated to about 95° C.-98° C.

Once the mixture has melted, it is homogenized by stirring using a Moritz blender (stirring of rotor-stator type constituted by a fixed part in which a mobile second part rotates at variable speed), so as to disperse the pigments.

The composition is then used hot in liquid form to be deposited on the moulds or at room temperature in solid form.

The formulation is prepared using the weight proportions described below.

| Compounds | % by weight (relative to the total weight of the composition) |
|---|---|
| Mixture of copolymer of ethylene-vinyl acetate and of paraffin sold under the name COOL BIND 34-1300 ® by the company National Starch | 90 |
| Iron oxide sold under the name SUNPURO BLACK IRON OXIDE C33-7001 by the company SUN | 10 |

2) Device

The device used in Example 1 is as described in reference to FIGS. 1 to 3 with the mould described in FIG. 8 or 9.

3) Implementation

The molten cosmetic composition based on thermoplastic polymer is placed in the imprints of the mould using a pipette or a syringe, and the excess is then scraped off with a razor blade, if necessary. The assembly is then left to cool.

The two parts of the mould are then placed on the jaws of the device.

Heating is actuated by powering the heating element of the device for 4 minutes until a temperature of about 60° C. is reached within the composition.

Heating is then stopped while the two jaws are clamped on the eyelash fringe so as to imprison it.

The assembly is left to cool for 4 minutes. At the end of the 4 minutes, the two jaws are moved apart.

The two parts of the mould remain attached to the eyelash fringe. The two parts of the mould are therefore moved apart, by pulling along their width, in order to release the eyelashes.

Makeup with an enhanced tip effect is obtained on the eyelashes.

Example 2: Assembly Containing a Wax-Based Composition and a Device which has a Heating Element 1) Cosmetic Composition A composition in accordance with the invention is prepared as described below.

All the starting materials used are weighed out using a balance (accuracy 0.01 g). The compounds are melted in a jacketed 500 ml heating pan with circulation of hot oil to control the temperature. The assembly is heated to about 95° C.-98° C.

Once the mixture has melted, it is homogenized by stirring using a Moritz blender (stirring of rotor-stator type constituted by a fixed part in which a mobile second part rotates at variable speed), so as to disperse the pigments.

The composition is then used hot in liquid form to be deposited on the moulds or at room temperature in solid form.

The formulation is prepared using the weight proportions described below.

| Compounds | % by weight (relative to the total weight of the composition) |
|---|---|
| Beeswax sold under the name White Beeswax SP-453P by the company Strahl & Pitsch | 90 |
| Iron oxide sold under the name SUNPURO BLACK IRON OXIDE C33-7001 by the company SUN | 10 |

2) Device

The device used is identical to that of Example 1.

3) Implementation

The wax-based cosmetic composition is placed in the imprints of the mould.

The device and the cosmetic composition are used in the same way as illustrated in Example 1.

Example 3: Assembly Containing a Composition Based on a Semi-Crystalline Polymer and a Device which has a Heating Element 1) Cosmetic Composition A composition in accordance with the invention is prepared as described in Example 2.

The formulation is prepared using the weight proportions described below.

| Compounds | % by weight (relative to the total weight of the composition) |
|---|---|
| Poly($C_{10}$-$C_{30}$)alkyl acrylate sold under the name Intelimer IPA 13-1 NG by the company Air products and Chemicals | 85 |
| Iron oxide sold under the name SUNPURO BLACK IRON OXIDE C33-7001 by the company SUN | 15 |

2) Device

The device used is identical to that of Example 1.

3) Implementation

The cosmetic composition based on semicrystalline polymer is placed in the imprints of the mould.

The device and the cosmetic composition are used in the same way as illustrated in Example 1.

Example 4: Assembly Containing a Fluid Composition and a Device which has a Heating Element 1) Fluid Cosmetic Composition The fluid cosmetic composition used is identical to that sold under the name Volume Million Lashes Mascara by the company L'Oréal. This composition has a viscosity of about 4 Pa·s.

2) Device

The device used is identical to that of Example 1.

3) Implementation

The cosmetic composition is placed in the imprints of the mould.

The device and the cosmetic composition are used in the same way as illustrated in Example 1.

Examples 5 and 6: Fluid Composition Containing Particles in the Dispersed State

Example 5: Assembly Containing a Composition Based on Wax and Latex and a Device which has a Heating Element 1) Solidifiable Cosmetic Composition A composition in accordance with the invention is prepared using the weight proportions described below.

The composition is fluid at room temperature.

| Compounds | % by weight (relative to the total weight of the composition) |
|---|---|
| Aqueous microdispersion of carnauba wax sold under the name Mexoryl SAP by the company Chimex | 50 |
| Latex Styrene/Acrylate/Ammonium Methacrylate copolymer sold under the name Syntran 5760 CG by the company Interpolymer | 50 |

2) Device

The device used in Example 9 is as described in Example 1 modified so that the heating can start after closure of the mould.

3) Implementation

The solidifiable cosmetic composition based on wax and latex is placed in the imprints of the mould.

The two jaws containing the two parts of the mould are moved near to the eyelash fringe and then tightened together so as to trap it.

Heating is actuated by virtue of the heating element of the device for 5 minutes until a temperature of about 70° C. is reached.

Heating is then stopped and the assembly is left to cool for 10 minutes. The two jaws are then opened. The cosmetic composition has become solid by aggregation of the particles during the increase in temperature.

The two parts of the mould remain attached to the eyelash fringe. The two parts of the mould are therefore moved apart, by pulling along their width, in order to release the eyelashes.

The result is then slightly rubbed in order to break the possible bridges of composition formed between two imprints.

The eyelashes are coated with a smooth, homogeneous and cohesive deposit, with an enhanced eyelash effect.

Example 6: Assembly Containing a Composition Based on Latex and Ethanol and a Device which has a Heating Element 1) Solidifiable Cosmetic Composition A composition in accordance with the invention is prepared using the weight proportions described below.

The composition is fluid at room temperature.

| Compounds | % by weight (relative to the total weight of the composition) |
|---|---|
| Latex Polyester-5 sold under the name Eastman AQ 55 S Polymer by the company Eastman Chemicals | 40 |
| Ethanol | 20 |
| Water | qs 100 |

2) Device

The device used is identical to that of Example 5.

3) Implementation

The solidifiable cosmetic composition based on latex and ethanol is placed in the imprints of the mould.

The two jaws are moved near to the eyelash fringe and then tightened together so as to trap it.

Heating is actuated by virtue of the heating element of the device for 5 minutes until a temperature of about 70° C. is reached.

Heating is then stopped and the assembly is left to cool for 10 minutes. The two jaws are then opened. The cosmetic composition has become solid by aggregation of the latex particles during the increase in temperature.

The two parts of the mould remain attached to the eyelash fringe. The two parts of the mould are therefore moved apart, by pulling along their width, in order to release the eyelashes.

The result is then slightly rubbed in order to break the possible bridges of composition formed between two imprints.

The eyelashes are coated with a smooth, homogeneous and cohesive deposit. An enhanced tip effect is obtained.

Examples 7 to 12: Fluid Composition Comprising an Activatable Compound

Example 7: Assembly Containing a Composition Based on Methacrylate Compounds

1) Cosmetic Composition

A composition in accordance with the invention is prepared. The formula is constituted by 100% by weight of methacrylate compounds sold under the name Power Polish™ Top Coat by the company CND Shellac. The composition is handled while taking care to avoid contact with daylight.

2) Device

The device used in Example 11 comprises two jaws that are movable on columns. The two parts of the mould, placed between two mobile jaws, are made of UV-transparent silicone elastomer (Platsil gel 10 (A:B) reactive silicones sold by the company Polytek) and have the imprints represented in FIG. 8 or 9.

3) Implementation

The cosmetic composition based on methacrylate compounds is placed in the imprints of the lower part of the mould. The upper part of the mould is then put in place.

The two parts of the mould are then placed on the jaws of the device.

The two jaws are moved near to the eyelash fringe and then tightened together so as to trap it.

The assembly is placed in proximity to a UVA source (UV lamp used for UV gels producing 36 W).

After 4 minutes of exposure, the two jaws are opened and the sculptures are released.

Homogeneous makeup with an enhanced eyelash effect is obtained on the eyelashes.

Example 8: Assembly Containing a Reactive Composition Based on Ethyl Cyanoacrylate 1) Cosmetic Composition A composition in accordance with the invention is prepared. The formula consists of 100% by weight of ethyl cyanoacrylate sold under the name Superglue 3 by the company Loctite. The composition is handled while taking care to avoid contact with water.

2) Device

The device used is identical to that of Example 7.

3) Implementation

The cosmetic composition based on ethyl cyanoacrylate is placed in the grooves of the lower part of the mould. The upper part of the mould is moistened by spraying so as to deposit thereon 0.3 g of water, and then put in place.

The two parts of the mould are then placed on the jaws of the device.

The two jaws (3*a*) and (3*b*) are moved near to the eyelash fringe and then tightened together so as to trap it.

After waiting for 4 minutes, the two jaws are opened and the sculptures are released.

Example 9: Assembly Containing a Composition Based on a Reactive Silicone

1) Cosmetic Composition

A composition in accordance with the invention is prepared. The formulation is constituted by 100% by weight of a reactive silicone sold under the name Joint & Fix by the company GEB. The composition is handled while taking care to avoid contact with water.

2) Device

The device used is identical to that of Example 7.

3) Implementation

The cosmetic composition based on reactive silicone is placed in the imprints of the lower part of the mould. The upper part of the mould is moistened by spraying so as to deposit thereon 0.1 g of water, and then put in place.

The two parts of the mould are then placed on the jaws of the device.

The two jaws are moved near to the eyelash fringe and then tightened together so as to trap it.

After waiting for 12 minutes, the two jaws are opened and the sculptures are released.

A homogeneous makeup result is obtained on the eyelashes, with an enhanced tip effect.

Example 10: Assembly Containing a Composition Based on Reactive Silicones

1) Cosmetic Composition

A composition in accordance with the invention is prepared. The formulation consists of two components of Platsil gel 10 (A:B) reactive silicones sold by the company Polytek.

The two compounds are mixed and the mixture is introduced into the mould without delay, less than 3 minutes after preparing the mixture.

2) Device

The device used is identical to that of Example 7.

3) Implementation

The cosmetic composition based on reactive silicones is placed, immediately after it has been prepared, in the imprints of the lower part of the mould. The upper part of the mould is then put in place.

The two parts of the mould are then placed on the jaws of the device.

The two jaws are moved near to the eyelash fringe and then tightened together so as to trap it.

After waiting for 7 minutes, the two jaws are opened and the sculptures are released.

A homogeneous makeup result is obtained on the eyelashes, without any eyelash brushing movement. The makeup is easy to apply without any need to calibrate the amount of composition taken and applied.

Example 11: Assembly Containing a Composition Based on Reactive Silicones

1) Cosmetic Composition

A composition in accordance with the invention is prepared. The formulation consists of two components of Platsil gel 10 (A:B) reactive silicones sold by the company Polytek. The mixing of the components is carried out in situ in the device.

2) Device

The device used is identical to that of Example 7.

3) Implementation

Component A is placed in the grooves of the lower part of the mould. As regards compound B, it is placed in the upper part of the mould.

The two parts of the mould are then placed on the jaws of the device.

The two jaws are moved near to the eyelash fringe and then tightened together so as to trap it.

After waiting for 7 minutes, the two jaws are opened and the sculptures are released.

A homogeneous makeup result is obtained on the eyelashes, with an enhanced eyelash effect.

Example 12: Assembly Containing a Composition of Sodium Alginate and Calcium Chloride 1) Cosmetic Composition A composition in accordance with the invention is prepared as described below.

The formulation is constituted by, on the one hand, a solution of sodium alginate (sold under the name Kelcosol by the company ISP) at 5% and, on the other hand, an aqueous solution of calcium chloride at 3%, having a pH=7, gelled with a nonionic hydroxyethylcellulose thickener at 2%. The compositions are prepared by dissolving the compounds in water.

The mixing of the components is carried out in situ in the device.

2) Device

The device used is identical to that of Example 11.

3) Implementation

The solution based on sodium alginate is placed in the imprints of the lower part of the mould. As regards the gelled solution based on calcium chloride, it is placed, in an amount equivalent to the amount of alginate solution, in the upper part of the mould.

The two parts of the mould are then placed on the jaws of the device.

The two jaws are moved near to the eyelash fringe and then tightened together so as to trap it.

After waiting for 3 minutes, the two jaws are opened and the sculptures are released.

A homogeneous makeup result is obtained on the eyelashes, with an enhanced eyelash effect.

Examples 13 to 15: Ductile Composition

Example 13

1) Cosmetic Composition

A composition in accordance with the invention is prepared using the weight proportions described below.

| Compounds | % by weight (relative to the total weight of the composition) |
|---|---|
| Carnauba wax sold under the name *Copernicia cerifera* wax by the company Bauerlocher | 3.2 |
| Beeswax sold under the name Cera Alba by the company Strahl & Pitsch | 4.1 |
| Paraffin wax sold under the name Paraffine raffinée [Refined paraffin] by the company Avel | 12.9 |
| Hydroxyethylcellulose sold under the name Hydroxyethylcellulose by the company Amerchol | 0.9 |
| Gum arabic sold under the name Acacia Senegal by the company Alland & Robert | 3.4 |
| Iron oxide | 7.1 |
| Preserving agent | 1 |
| Cetyl phosphate sold under the name Arlatone MAP by the company Uniqema | 6.7 |
| Steareth-2 sold under the name Brij 72 by the company Uniqema | 3.3 |
| Water | qs 100 |

2) Device

The device used in Example 13 comprises two jaws that are movable on columns. The two parts of the mould, placed between two mobile jaws, are made of silicone elastomer (Platsil gel 10 (A:B) reactive silicones sold by the company Polytek). The mould is as described in FIG. 8 or 9.

Under compression, the mould deforms and pushes the cavities to reduce their volume.

3) Implementation

Vegetable oil and boron nitride powder in the form of platelets (Boron Nitride from the company Merck) are placed, in a proportion of respectively 25 mg and 50 mg, in each of the parts of the mould.

The cosmetic composition described above is then placed in the imprints of the two parts of the mould, until they are filled.

The composition is left to dry for 10 minutes.

The two jaws containing the two parts of the mould are moved near to the eyelash fringe and then tightened together so as to trap it.

The eyelashes are strongly compressed, by applying a pressure of about 4 kg on the upper jaw for 1 minute.

The two jaws are then opened and the sculptures are released.

A homogeneous makeup result is obtained on the eyelashes, with an enhanced eyelash effect. The layer of mascara has taken the shape of the mould.

Example 14

1) Cosmetic Composition

A composition in accordance with the invention is prepared using the weight proportions described below by dissolving the sulfonic polyester in ethanol.

| Compounds | % by weight (relative to the total weight of the composition) |
|---|---|
| Sulfonic polyester sold under the name sulfonic polyester AQ 1350 by the company Eastman Chemicals | 60 |
| Ethanol | 40 |

2) Device

The device used is identical to that of Example 13.

3) Implementation

Vegetable oil and boron nitride powder in platelet form (Boron Nitride from the company Merck) are placed, in a proportion, respectively, of 25 mg and 50 mg, into each of the parts of the mould.

The cosmetic composition described above is then placed in the imprints of the mould, until they are filled.

The composition is left to dry for 24 hours.

The two jaws containing the two parts of the mould are moved near to the eyelash fringe and then tightened together so as to trap it.

The eyelashes are strongly compressed, by applying a pressure of about 4 kg on the upper jaw for 1 minute.

The two jaws are then opened and the units formed are released.

A homogeneous makeup result is obtained on the eyelashes, with an enhanced eyelash effect. The layer of mascara has taken the shape of the mould.

Example 15

1) Cosmetic Composition

A composition in accordance with the invention is prepared. It consists of Chavant modelling clay sold by the company Esprit composite under the name Plastiline Ivoire.

2) Device

The device used is identical to that of Example 13.

3) Implementation

Vegetable oil and boron nitride powder in platelet form (Boron Nitride from the company Merck) are placed, in a proportion, respectively, of 25 mg and 50 mg, into each of the parts of the mould.

The cosmetic composition described above is then placed in the imprints of the mould, until they are filled.

The two jaws containing the two parts of the mould are moved near to the eyelash fringe and then tightened together so as to trap it.

The eyelashes are strongly compressed, by applying a pressure of about 4 kg on the upper jaw for 1 minute.

The two jaws are then opened and the sculptures are released.

The material has integrated the eyelashes, while taking the shape of the mould.

Example 16

A mould is made from a silicone material, with, on one of the mould parts, a curvilinear groove about 3 cm long, 2 mm wide and 1 mm high, as illustrated in FIG. 16. It is filled with a hot-melt composition. After cooling, the article made is released.

This article is then placed on a heated eyelash curling machine, for example a Talika brand machine.

The eyelash curler is used as a heated applicator, taking care not to curl the eyelashes.

Test 1

The eyelashes are combed and the strip of hot-melt composition is then applied.

Test 2

The strip of hot-melt composition is applied, followed by combing before cooling.

Test 3

The eyelashes are kept aligned by using a comb for the time of application of the composition strip.

For these three tests, discipline results are obtained, even on an undisciplined fringe.

The same tests are performed with a coloured material (black or flesh-coloured). In the first case, the eyelashes are disciplined with, in addition, a liner effect. In the second case, an eyelid extension effect is obtained, which is especially advantageous in the case of eyes that are too open ("round eye").

The figures and the examples were described with eyelashes as treated keratin fibres, but these figures and examples also apply to other types of keratin fibres, especially to eyebrows or the hair.

The implementation particularities of the various examples described can be combined within variants which are not illustrated.

The invention claimed is:

1. An assembly comprising:

at least one cosmetic composition for the cosmetic treatment of eyelashes or eyebrows, the at least one cosmetic composition being:

a hot-melt composition with a melting point of between 40° C. and 120° C. selected from the group consisting of thermoplastic polymers, waxes, semi-crystalline polymers, and mixtures thereof, or a fluid composition containing particles in the dispersed state being an aqueous dispersion of film-forming polymer particles, the film-forming polymer comprising a latex or pseudolatex, or a fluid composition comprising a compound that is activatable by a chemical stimulus, or a ductile composition comprising at least one compound chosen from a wax, an oil, a gum, a modelling clay, a long-chain organic compound, a polymer which has a $T_g$ ranging from −20° C. to 20° C., and mixtures thereof, and a device comprising a mould comprising two mould parts to be closed on the eyelashes, at least one of these parts having a concave groove, which is concave towards a proximal edge of the mould, longitudinal ends of the groove being closed, allowing a formation of a strip of said at least one composition connecting at least part of the eyelashes along the eyelid or the eyebrow arch.

2. The assembly according to claim 1, the mould comprising cavities in which the eyelashes engage and which constrain the eyelashes to take a certain orientation during the formation of the strip.

3. The assembly according to claim 1, the concave groove having a constant width along its longitudinal axis.

4. The assembly according to claim 1, a width of the concave groove varying to form the strip with a variable width.

5. The assembly according to claim 1, in which a depth of the concave groove is constant along its longitudinal axis.

6. The assembly according to claim 1, a depth of the concave groove varying along its longitudinal axis.

7. The assembly according to claim 1, a distance from the concave groove to the proximal edge of the mould being less than or equal to 2 mm.

8. The assembly according to claim 1, the longitudinal axis of the concave groove being without any straight segments.

9. The assembly according to claim 1, the concave groove being unique on the mould part which bears it.

10. The assembly according to claim 1, the concave groove being arranged to allow the formation of a continuous composition strip on the entire eyelash fringe.

11. The assembly according to claim 1, the mould comprising, besides the concave groove for moulding the composition strip, at least one additional cavity intended to receive an eyelash to mould the composition thereon.

12. The assembly according to the claim 11, with several additional cavities, the concave groove intersecting them such that, for each cavity, the intersection takes place substantially at the same distance from a proximal end of the cavity.

13. The assembly according to claim 11, the cavities having a proximal end that opens into the concave groove.

14. The assembly according to claim 1, the concave groove being curvilinear.

15. A process for treating eyelashes or eyebrows with the assembly of claim 1, in which at least one curvilinear strip of the cosmetic composition which connects the eyelashes together, by being oriented transversely thereto, is applied to the eyelashes, with the aid of the device further comprising two jaws to be tightened on the eyelashes.

16. The process according to claim 15, wherein the at least one curvilinear strip is preformed, and fixed onto the eyelashes by being melted on contact therewith.

17. The process according to claim 15, wherein the at least one curvilinear strip is formed in situ on the eyelashes using the device of claim 1.

18. The process according to claim 15, in which the composition is the hot-melt composition, the process further comprising combing the eyelashes prior to applying the at least one curvilinear strip.

19. The process according to claim 15, in which the cosmetic composition is applied to the eyelashes in molten form, or is melted on contact with the eyelashes;

and the eyelashes are combed before cooling and setting of the cosmetic composition.

20. The process according to claim 15, in which the eyelashes are subjected to the action of a comb or vibrations while applying the cosmetic composition and cooling the cosmetic composition.

21. The process according to claim 15, in which the eyelashes are separated using a comb to give the eyelash fringe a greater span, the comb having teeth which are mobile and designed to move away from each other after introduction between the eyelashes, wherein the eyelashes are held separated by providing the at least one curvilinear strip of cosmetic composition strip.

22. The process according to claim 15, wherein the composition is applied and cooled, after which a heating step is performed so as to melt the cosmetic composition and to modify the orientation of the eyelashes.

23. The assembly according to claim 1, the at least one cosmetic composition being a hot-melt composition with a melting point of between 40° C. and 120° C. comprising a thermoplastic polymer comprising ethylene-vinyl acetate (EVA).

24. The assembly according to claim 1, the at least one cosmetic composition being a hot-melt composition with a melting point of between 40° C. and 120° C. comprising a semi-crystalline polymer comprising vinyl acetate/allyl stearate copolymers.

25. The assembly according to claim 1, wherein the groove being arranged to allow the formation of a continuous strip of composition over the entire eyelash fringe.

26. The assembly according to claim 1, wherein the mould comprising at least one additional cavity intended to receive an eyelash for moulding the cosmetic composition thereon, the or each additional cavity extending from the groove toward a distal end of the mould.

27. The assembly according to claim 1, the length of the strip being greater than or equal to 20 mm.

28. The assembly of claim 1, wherein one part of the mould has a concave groove, which is concave towards a proximal edge of the mould, the other part having such a concave groove or being smooth.

29. An assembly comprising:

at least one cosmetic composition for the cosmetic treatment of eyelashes or eyebrows, the at least one cosmetic composition being:

a hot-melt composition with a melting point of between 40° C. and 120° C. selected from the group consisting of thermoplastic polymers, waxes, semi-crystalline polymers, and mixtures thereof, or a fluid composition containing particles in the dispersed state being an aqueous dispersion of film-forming polymer particles, the film-forming polymer comprising a latex or pseudolatex, or a fluid composition comprising a compound that is activatable by a chemical stimulus, or a ductile composition comprising at least one compound chosen from a wax, an oil, a gum, a modelling clay, a long-chain organic compound, a polymer which has a Tg ranging from −20° C. to 20° C., and mixtures thereof, and a device comprising a mould comprising two mould parts to be closed on the eyelashes, at least one of these parts having a concave groove, which is concave towards a proximal edge of the mould, allowing a formation of a strip of said at least one cosmetic composition connecting at least part of the eyelashes along the eyelid or the eyebrow arch, the mould comprising at least one additional cavity intended to receive an eyelash for moulding the cosmetic composition thereon, the or each additional cavity extending from the groove towards a distal end of the mould onto which the cavities are opened.

* * * * *